US012180966B2

(12) United States Patent
Gehret et al.

(10) Patent No.: US 12,180,966 B2
(45) Date of Patent: Dec. 31, 2024

(54) COMPRESSOR WITH FUNNEL ASSEMBLY

(71) Applicant: Copeland LP, Sidney, OH (US)

(72) Inventors: Natalie M. Gehret, Yorkshire, OH (US); Jason P. Lochner, Union, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/530,916

(22) Filed: Dec. 6, 2023

(65) Prior Publication Data

US 2024/0209858 A1 Jun. 27, 2024

Related U.S. Application Data

(60) Provisional application No. 63/434,703, filed on Dec. 22, 2022.

(51) Int. Cl.

| | |
|---|---|
| ***F04C 18/02*** | (2006.01) |
| ***F04C 23/00*** | (2006.01) |
| ***F04C 29/12*** | (2006.01) |

(52) U.S. Cl.

CPC ..... *F04C 29/12* (2013.01); *F04C 18/0207* (2013.01); *F04C 18/0215* (2013.01); *F04C 23/008* (2013.01)

(58) Field of Classification Search

CPC ..... F04C 29/12; F04C 18/0215; F04C 18/0207; F04C 23/008

See application file for complete search history.

(56) References Cited

U.S. PATENT DOCUMENTS

| | | | |
|---|---|---|---|
| 1,365,530 | A | 1/1921 | Moore |
| 2,142,452 | A | 1/1939 | Merrill |
| 2,157,918 | A | 5/1939 | Rankin |
| 2,855,139 | A | 10/1958 | Weibel, Jr. |
| 3,075,686 | A | 1/1963 | Steinhagen |
| 3,270,952 | A | 9/1966 | Bellmer |
| 3,817,661 | A | 6/1974 | Ingalls et al. |
| 3,870,440 | A | 3/1975 | Zuercher, Jr. |

(Continued)

FOREIGN PATENT DOCUMENTS

| | | | |
|---|---|---|---|
| CN | 1208821 | A | 2/1999 |
| CN | 1278892 | A | 1/2001 |

(Continued)

OTHER PUBLICATIONS

Non-Final Office Action regarding U.S. Appl. No. 16/941,060 dated Aug. 2, 2021.

(Continued)

*Primary Examiner* — Deming Wan

(74) *Attorney, Agent, or Firm* — Harness, Dickey & Pierce, P.L.C.

(57) ABSTRACT

A compressor may include an orbiting scroll, a non-orbiting scroll, and suction conduit. The non-orbiting scroll is meshingly engaged with the orbiting scroll and includes a lower scroll piece and an upper scroll piece that is mounted to the lower scroll piece. The suction conduit is mounted to the non-orbiting scroll. The suction conduit includes an inlet, an outlet, and a mounting flange. The outlet is disposed adjacent to and in fluid communication with a suction inlet of the non-orbiting scroll. At least a portion of the mounting flange is captured between the upper and lower scroll pieces.

21 Claims, 16 Drawing Sheets

(56) References Cited

U.S. PATENT DOCUMENTS 4,313,715 A 2/1982 Richardson, Jr.
4,343,599 A 8/1982 Kousokabe
4,365,941 A 12/1982 Tojo et al.
4,401,418 A 8/1983 Fritchman
4,412,791 A 11/1983 Lal
4,477,229 A 10/1984 Kropiwnicki et al.
4,496,293 A 1/1985 Nakamura et al.
4,564,339 A 1/1986 Nakamura et al.
4,592,703 A 6/1986 Inaba et al.
4,609,334 A 9/1986 Muir et al.
4,648,811 A 3/1987 Tahata et al.
4,696,629 A 9/1987 Shiibayashi et al.
4,759,696 A 7/1988 Ishiai
4,767,293 A 8/1988 Caillat et al.
4,793,775 A 12/1988 Peruzzi
4,838,769 A 6/1989 Gannaway
4,877,382 A 10/1989 Caillat et al.
4,915,554 A 4/1990 Serizawa et al.
4,969,804 A 11/1990 Gannaway
5,007,809 A 4/1991 Kimura et al.
5,030,073 A 7/1991 Serizawa et al.
5,055,010 A 10/1991 Logan
5,064,356 A 11/1991 Horn
5,108,274 A 4/1992 Kakuda et al.
5,114,322 A 5/1992 Caillat et al.
5,197,868 A 3/1993 Caillat et al.
5,219,281 A 6/1993 Caillat et al.
5,240,391 A 8/1993 Ramshankar et al.
5,288,211 A 2/1994 Fry
5,295,813 A 3/1994 Caillat et al.
5,306,126 A 4/1994 Richardson, Jr.
5,344,289 A 9/1994 Fasce
5,366,352 A 11/1994 Deblois et al.
5,427,511 A 6/1995 Caillat et al.
5,435,700 A 7/1995 Park
5,439,361 A 8/1995 Reynolds et al.
5,476,369 A 12/1995 Fowlkes et al.
5,531,078 A 7/1996 Day et al.
5,533,875 A 7/1996 Crum et al.
5,593,294 A 1/1997 Houghtby et al.
5,597,293 A 1/1997 Bushnell et al.
5,645,408 A 7/1997 Fujio et al.
5,707,210 A 1/1998 Ramsey et al.
5,745,992 A 5/1998 Caillat et al.
5,772,411 A 6/1998 Crum et al.
5,772,416 A 6/1998 Caillat et al.
5,931,649 A 8/1999 Caillat et al.
5,992,033 A 11/1999 Scarborough
6,000,917 A 12/1999 Smerud et al.
6,017,205 A 1/2000 Weatherston et al.
6,131,406 A 10/2000 Barowsky et al.
6,139,295 A 10/2000 Utter et al.
6,158,995 A 12/2000 Muramatsu et al.
6,164,934 A 12/2000 Niihara et al.
6,168,404 B1 1/2001 Gatecliff
6,174,150 B1 1/2001 Tsubono et al.
6,186,753 B1 2/2001 Hugenroth et al.
6,244,834 B1 6/2001 Matsuda et al.
6,261,071 B1 7/2001 Williams et al.
6,293,776 B1 9/2001 Hahn et al.
6,352,418 B1 3/2002 Kohsokabe et al.
6,364,643 B1 4/2002 Milliff
6,402,485 B2 6/2002 Hong et al.
6,454,538 B1 9/2002 Witham et al.
6,474,964 B2 11/2002 De Bernardi et al.
6,537,019 B1 3/2003 Dent
6,685,441 B2 2/2004 Nam
6,709,244 B2 3/2004 Pham
6,736,607 B2 5/2004 Ginies et al.
6,814,546 B2 11/2004 Sekiguchi
6,857,808 B1 2/2005 Sugimoto et al.
6,887,050 B2 5/2005 Haller
6,896,496 B2 5/2005 Haller et al.
7,018,183 B2 3/2006 Haller et al.
7,018,184 B2 3/2006 Skinner et al.
7,063,523 B2 6/2006 Skinner
7,094,043 B2 8/2006 Skinner
7,108,494 B2 9/2006 Nam
7,137,775 B2 11/2006 Hopkins
7,147,443 B2 12/2006 Ogawa et al.
7,207,787 B2 4/2007 Liang et al.
7,311,501 B2 12/2007 Wehrenberg et al.
7,318,710 B2 1/2008 Lee et al.
7,416,395 B2 8/2008 Sato
7,503,755 B2 3/2009 Lai et al.
RE40,830 E 7/2009 Caillat
7,686,592 B2 3/2010 Inoue et al.
7,699,589 B2 4/2010 Terauchi et al.
7,708,536 B2 5/2010 Ginies et al.
7,771,180 B2 8/2010 Cho et al.
7,862,312 B2 1/2011 Gopinathan
7,905,715 B2 3/2011 Hiwata et al.
8,133,043 B2 3/2012 Duppert
8,152,503 B2 4/2012 Haller
8,348,647 B2 1/2013 Kiyokawa et al.
8,814,537 B2 8/2014 Ignatiev et al.
8,974,198 B2 3/2015 Schaefer et al.
8,992,186 B2 3/2015 Silveira et al.
9,051,934 B2 6/2015 Fraser
9,057,270 B2 6/2015 Strawn et al.
9,366,462 B2 6/2016 Perevozchikov et al.
10,094,600 B2 10/2018 Doepker et al.
11,236,748 B2 2/2022 King
11,619,228 B2 4/2023 Kingseed et al.
2001/0006603 A1 7/2001 Hong et al.
2001/0055536 A1 12/2001 Bernardi et al.
2002/0090305 A1 7/2002 Myung et al.
2003/0072662 A1 4/2003 Reinhart
2004/0057843 A1 3/2004 Haller et al.
2004/0057849 A1 3/2004 Skinner et al.
2004/0057857 A1 3/2004 Skinner
2004/0126258 A1 7/2004 Lai et al.
2004/0166008 A1 8/2004 Lai et al.
2004/0170509 A1 9/2004 Wehrenberg et al.
2004/0228751 A1 11/2004 Shin
2005/0129534 A1 6/2005 Lee
2006/0073061 A1 4/2006 Sato
2006/0078452 A1 4/2006 Park et al.
2006/0127262 A1 6/2006 Shin et al.
2006/0177335 A1 8/2006 Hwang et al.
2006/0222545 A1 10/2006 Nam et al.
2006/0222546 A1 10/2006 Lee et al.
2006/0245967 A1 11/2006 Gopinathan
2006/0275150 A1 12/2006 Barth
2007/0178002 A1 8/2007 Hiwata et al.
2007/0183914 A1 8/2007 Gopinathan
2007/0237664 A1 10/2007 Joo et al.
2009/0110586 A1 4/2009 Brabek et al.
2009/0136344 A1 5/2009 Chen et al.
2009/0229303 A1 9/2009 Iversen et al.
2010/0021330 A1 1/2010 Haller
2010/0092320 A1 4/2010 Duppert
2012/0134859 A1 5/2012 Duppert
2012/0148433 A1 6/2012 Liang et al.
2012/0328424 A1 12/2012 Berger et al.
2013/0026749 A1 1/2013 O'Brien et al.
2013/0039792 A1 2/2013 Hiratsuka et al.
2013/0081710 A1 4/2013 Ignatiev et al.
2013/0089451 A1 4/2013 Ahn et al.
2013/0108496 A1 5/2013 Nakai et al.
2013/0129549 A1 5/2013 Sakuda et al.
2014/0017106 A1 1/2014 Strawn et al.
2014/0069139 A1 3/2014 Perevozchikov et al.
2016/0298885 A1 10/2016 Doepker et al.
2016/0348675 A1 12/2016 Ishii et al.
2017/0002812 A1 1/2017 Duppert
2018/0320689 A1 11/2018 Kono et al.
2019/0041106 A1 2/2019 Piscopo
2019/0041107 A1 2/2019 Pliscopo et al.
2020/0309124 A1* 10/2020 King ..... F04C 29/12

(56) References Cited

U.S. PATENT DOCUMENTS

| | | | |
|---|---|---|---|
| 2020/0392953 | A1 | 12/2020 | Stover et al. |
| 2022/0235762 | A1 | 7/2022 | Kingseed et al. |

FOREIGN PATENT DOCUMENTS

| | | | |
|---|---|---|---|
| CN | 1321836 | A | 11/2001 |
| CN | 1354326 | A | 6/2002 |
| CN | 1371444 | A | 9/2002 |
| CN | 1482365 | A | 3/2004 |
| CN | 1629476 | A | 6/2005 |
| CN | 1779244 | A | 5/2006 |
| CN | 1869443 | A | 11/2006 |
| CN | 101235932 | A | 8/2008 |
| CN | 101415947 | A | 4/2009 |
| CN | 102216617 | A | 10/2011 |
| CN | 202926625 | U | 5/2013 |
| CN | 103201516 | A | 7/2013 |
| CN | 203453064 | U | 2/2014 |
| CN | 104350279 | A | 2/2015 |
| CN | 104976448 | A | 10/2015 |
| CN | 104999172 | A | 10/2015 |
| CN | 204934897 | U | 1/2016 |
| CN | 205064214 | U | 3/2016 |
| CN | 107246393 | A | 10/2017 |
| CN | 111065823 | A | 4/2020 |
| EP | 0438243 | A1 | 7/1991 |
| EP | 475545 | A1 | 3/1992 |
| EP | 0529660 | A1 | 3/1993 |
| EP | 1338795 | A1 | 8/2003 |
| EP | 1541868 | A1 | 6/2005 |
| EP | 2 592 274 | B1 | 10/2018 |
| JP | S62182486 | A | 8/1987 |
| JP | S63183773 | A | 7/1988 |
| JP | H04347387 | A | 12/1992 |
| JP | H05157064 | A | 6/1993 |
| JP | H05302581 | A | 11/1993 |
| JP | H07197893 | A | 8/1995 |
| JP | H08319965 | A | 12/1996 |
| JP | H11141470 | A | 5/1999 |
| JP | 2001165065 | A | 6/2001 |
| JP | 2002155875 | A | 5/2002 |
| JP | 2002155877 | A | 5/2002 |
| JP | 2002235524 | A | 8/2002 |
| JP | 2003120539 | A | 4/2003 |
| JP | 2004150370 | A | 5/2004 |
| JP | 2005188353 | A | 7/2005 |
| JP | 2006144729 | A | 6/2006 |
| JP | 2008223605 | A | 9/2008 |
| JP | 2009019570 | A | 1/2009 |
| JP | 2010043627 | A | 2/2010 |
| JP | 2011236861 | A | 11/2011 |
| KR | 20010064538 | A | 7/2001 |
| KR | 20010068323 | A | 7/2001 |
| KR | 20020024708 | A | 4/2002 |
| KR | 20080019509 | A | 3/2008 |
| KR | 20090045352 | A | 5/2009 |
| KR | 20140034345 | A | 3/2014 |
| KR | 20180107482 | A | 10/2018 |
| KR | 20190025250 | A | 3/2019 |
| WO | 2006109475 | A1 | 10/2006 |
| WO | 2007025883 | A1 | 3/2007 |
| WO | 2007114582 | A1 | 10/2007 |
| WO | 2008102940 | A1 | 8/2008 |
| WO | 2009090856 | A2 | 7/2009 |
| WO | 2011147005 | A1 | 12/2011 |
| WO | 2014043444 | A1 | 3/2014 |

OTHER PUBLICATIONS

Notice of Allowance regarding U.S. Appl. No. 16/941,060 dated Oct. 6, 2021.
Notice of Allowance regarding U.S. Appl. No. 16/803,576 dated Sep. 16, 2021.
Restriction Requirement regarding U.S. Appl. No. 17/159,692 dated Apr. 11, 2022.
International Search Report regarding Application No. PCT/US2022/014027 dated May 4, 2022.
Written Opinion of ISA regarding Application No. PCT/US2022/014027 dated May 4, 2022.
Non-Final Office Action regarding U.S. Appl. No. 15/930,785 dated May 6, 2022.
Non-Final Office Action regarding U.S. Appl. No. 17/159,692 dated Jul. 21, 2022.
Notice of Allowance regarding U.S. Appl. No. 17/159,692 dated Dec. 2, 2022.
Office Action regarding Chinese Patent Application No. 2020800436550, dated Jan. 20, 2023.
Final Office Action regarding U.S. Appl. No. 15/930,785 dated Apr. 3, 2023.
Search Report regarding European Patent Application No. 207822644, dated Nov. 17, 2022.
Notice of Allowance regarding U.S. Appl. No. 15/930,785 dated Jun. 22, 2023.
International Search Report regarding International Application No. PCT/BR2010/000179, dated Sep. 1, 2010.
Written Opinion of the International Searching Authority regarding International Application No. PCT/BR2010/000179, dated Sep. 1, 2010.
International Search Report regarding International Application No. PCT/US2012/056067, dated Feb. 19, 2013.
Written Opinion of the International Searching Authority regarding International Application No. PCT/US2012/056067, dated Feb. 19, 2013.
Restriction Requirement regarding U.S. Appl. No. 13/610,274, dated Aug. 16, 2013.
Search Report regarding European Patent Application No. 10851912.5, dated Nov. 15, 2013.
Office Action regarding Japanese Patent Application No. 2013-511484, dated Nov. 19, 2013.
Office Action regarding U.S. Appl. No. 13/610,274, dated Nov. 27, 2013.
International Search Report regarding International Application No. PCT/US2013/059612, dated Dec. 9, 2013.
Written Opinion of the International Searching Authority regarding International Application No. PCT/US2013/059612, dated Dec. 9, 2013.
Office Action regarding U.S. Appl. No. 13/699,207, dated Dec. 18, 2013.
Notice of Allowance regarding U.S. Appl. No. 13/610,274, dated Mar. 24, 2014.
Notice of Allowance regarding U.S. Appl. No. 13/610,274, dated Jul. 18, 2014.
Office Action regarding European Patent Application No. 10851912.5, dated Jul. 18, 2014.
Office Action regarding U.S. Appl. No. 13/699,207, dated Jul. 24, 2014.
Office Action regarding Chinese Patent Application No. 201080066999.X, dated Sep. 17, 2014.
Notice of Allowance regarding U.S. Appl. No. 13/699,207, dated Nov. 24, 2014.
Office Action regarding Chinese Patent Application No. 201210376153.7, dated Dec. 3, 2014. Translation provided by Unitalen Attorneys At Law.
Restriction Requirement regarding U.S. Appl. No. 14/025,887, dated Jan. 5, 2015.
Restriction Requirement regarding U.S. Appl. No. 13/930,834, dated Jan. 29, 2015.
Office Action regarding U.S. Appl. No. 14/025,887, dated Mar. 26, 2015.
Notice of Allowance regarding U.S. Appl. No. 13/930,834, dated Apr. 24, 2015.
Office Action regarding Chinese Patent Application No. 201210376153.7, dated Jul. 3, 2015. Translation provided by Unitalen Attorneys at Law.
Office Action regarding U.S. Appl. No. 14/025,887, dated Jul. 23, 2015.

(56) References Cited

OTHER PUBLICATIONS

Office Action regarding Chinese Patent Application No. 201310286638.1, dated Jul. 27, 2015. Translation provided by Unitalen Attorneys at Law.
Office Action regarding U.S. Appl. No. 14/025,887, dated Dec. 3, 2015.
Office Action regarding Chinese Patent Application No. 201210376153.7, dated Dec. 28, 2015. Translation provided by Unitalen Attorneys at Law.
Office Action regarding Chinese Patent Application No. 201310286638.1, dated Jan. 21, 2016. Translation provided by Unitalen Attorneys at Law.
Office Action regarding Chinese Patent Application No. 201380047907.7, dated Mar. 8, 2016. Translation provided by Unitalen Attorneys at Law.
Notice of Allowance regarding U.S. Appl. No. 14/025,887, dated Apr. 12, 2016.
Search Report regarding European Patent Application No. 13836817.0, dated Jun. 1, 2016.
Office Action regarding Korean Patent Application No. 10-2012-7033723, dated Aug. 22, 2016.
Office Action regarding Chinese Patent Application No. 201380047907.7, dated Nov. 8, 2016. Translation provided by Unitalen Attorneys at Law.
Office Action regarding Chinese Patent Application No. 201380047907.7, dated Apr. 12, 2017. Translation provided by Unitalen Attorneys at Law.
Office Action regarding U.S. Appl. No. 15/180,570, dated Oct. 5, 2017.
Office Action regarding U.S. Appl. No. 15/180,570, dated Mar. 22, 2018.
Notice of Allowance regarding U.S. Appl. No. 15/180,570, dated May 31, 2018.
Notice of Allowance regarding U.S. Appl. No. 15/180,570, dated Jul. 19, 2018.
Office Action regarding Indian Patent Application No. 476/MUMNP/2015, dated Sep. 7, 2018.
Office Action regarding Indian Patent Application No. 10655/DELNP/2012, dated Sep. 28, 2018.
Office Action regarding European Patent Application No. 13836817.0, dated Sep. 10, 2019.
Office Action regarding U.S. Appl. No. 16/154,097, dated Jun. 23, 2020.
Office Action regarding U.S. Appl. No. 16/154,364, dated Aug. 17, 2020.
International Search Report regarding International Application No. PCT/US2020/025564, dated Jul. 8, 2020.
Written Opinion of the International Searching Authority regarding International Application No. PCT/US2020/025564, dated Jul. 8, 2020.
International Search Report regarding International Application No. PCT/US2020/037004, dated Sep. 21, 2020.
Written Opinion of the International Searching Authority regarding International Application No. PCT/US2020/037004, dated Sep. 21, 2020.
Notice of Allowance regarding U.S. Appl. No. 16/154,097, dated Oct. 27, 2020.
Notice of Allowance regarding U.S. Appl. No. 16/154,364, dated Jan. 6, 2021.
Non-Final Office Action regarding U.S. Appl. No. 16/803,576 dated Jun. 1, 2021.
Search Report regarding European Patent Application No. 23219843.2, dated Jul. 2, 2024.

* cited by examiner

COMPRESSOR WITH FUNNEL ASSEMBLY

CROSS-REFERENCE TO RELATED APPLICATIONS

This application claims the benefit of U.S. Provisional Application No. 63/434,703, filed on Dec. 22, 2022. The entire disclosure of the above application is incorporated herein by reference.

FIELD

The present disclosure relates to a compressor with a funnel assembly, and more particularly, to a scroll compressor with a suction funnel assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

Further areas of applicability will become apparent from the description provided herein. The description and specific examples in this summary are intended for purposes of illustration only and are not intended to limit the scope of the present disclosure.

SUMMARY

This section provides a general summary of the disclosure and is not a comprehensive disclosure of its full scope or all of its features.

In one form, the present disclosure provides a compressor that may include an orbiting scroll, a non-orbiting scroll, and suction conduit (or suction funnel). The non-orbiting scroll is meshingly engaged with the orbiting scroll and includes a lower scroll piece and an upper scroll piece that is mounted to the lower scroll piece. The suction conduit is mounted to the non-orbiting scroll. The suction conduit includes an inlet, an outlet, and a mounting flange. The outlet is disposed adjacent to and in fluid communication with a suction inlet of the non-orbiting scroll. At least a portion of the mounting flange is captured between the upper and lower scroll pieces.

In some configurations of the compressor of the above paragraph, the mounting flange includes a protrusion that is received in an opening in one of the upper and lower scroll pieces.

In some configurations of the compressor of the above paragraph, the protrusion is a pin and the opening is formed in the lower scroll piece.

In some configurations of the compressor of any one or more of the above paragraphs, the protrusion is a pin and the opening is formed in the upper scroll piece.

In some configurations of the compressor of any one or more of the above paragraphs, the protrusion is a lip extending in a first direction from the mounting flange, the opening is a slot formed in the upper scroll piece, and another lip extends from the mounting flange in a second direction opposite the first direction and is received in a slot formed in the lower scroll piece.

In some configurations of the compressor of any one or more of the above paragraphs, the lips and a main body of the mounting flange cooperate to form a T-shaped cross section.

In some configurations of the compressor of any one or more of the above paragraphs, one of the upper and lower scroll pieces includes a protrusion that is received in an opening in the mounting flange.

In some configurations of the compressor of any one or more of the above paragraphs, the suction conduit includes a mounting clip engaging the lower scroll piece of the non-orbiting scroll.

In some configurations of the compressor of any one or more of the above paragraphs, the mounting clip engages a wall of the lower scroll piece that is adjacent to the suction inlet of the non-orbiting scroll.

In some configurations of the compressor of any one or more of the above paragraphs, the upper scroll piece includes a plurality of mounting lobes that are circumferentially spaced apart from each other and extend radially outward from an outer rim of the upper scroll piece, and wherein one or more of the mounting lobes contacts the mounting flange.

In some configurations of the compressor of any one or more of the above paragraphs, the mounting flange is sandwiched between the upper and lower scroll pieces.

In another form, the present disclosure provides a compressor that may include an orbiting scroll, a non-orbiting scroll, and a suction conduit. The non-orbiting scroll may include a first scroll piece and a second scroll piece that is mounted to the first scroll piece. The first scroll piece includes a spiral wrap that is meshingly engaged with a spiral wrap of the orbiting scroll. A valve may be disposed between the first and second scroll pieces. The suction conduit may be mounted to the non-orbiting scroll. The suction conduit includes an inlet and an outlet. The outlet may be disposed adjacent to and in fluid communication with a suction inlet of the non-orbiting scroll. At least a portion of the suction conduit may be sandwiched between the first and second scroll pieces.

In some configurations of the compressor the above paragraph, the suction conduit includes a protrusion that is received in an opening in one of the first and second scroll pieces.

In some configurations of the compressor of any one or more of the above paragraphs, the protrusion is a pin and the opening is formed in the first scroll piece.

In some configurations of the compressor of any one or more of the above paragraphs, the protrusion is a pin and the opening is formed in the second scroll piece.

In some configurations of the compressor of any one or more of the above paragraphs, the protrusion is a lip extending in a first direction from a mounting flange of the suction conduit, the opening is a slot formed in the second scroll piece, and another lip extends from the mounting flange in a second direction opposite the first direction and is received in a slot formed in the first scroll piece.

In some configurations of the compressor of any one or more of the above paragraphs, the lips and a main body of the mounting flange cooperate to form a T-shaped cross section.

In some configurations of the compressor of any one or more of the above paragraphs, one of the first and second scroll pieces includes a protrusion that is received in an opening in the suction conduit.

In some configurations of the compressor of any one or more of the above paragraphs, the suction conduit includes a mounting clip engaging the first scroll piece of the non-orbiting scroll.

In some configurations of the compressor of any one or more of the above paragraphs, the mounting clip engages a wall of the first scroll piece that is adjacent to the suction inlet of the non-orbiting scroll.

In some configurations of the compressor of any one or more of the above paragraphs, the second scroll piece includes a plurality of mounting lobes that are circumferentially spaced apart from each other and extend radially outward from an outer rim of the second scroll piece, and wherein one or more of the mounting lobes contacts the suction conduit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
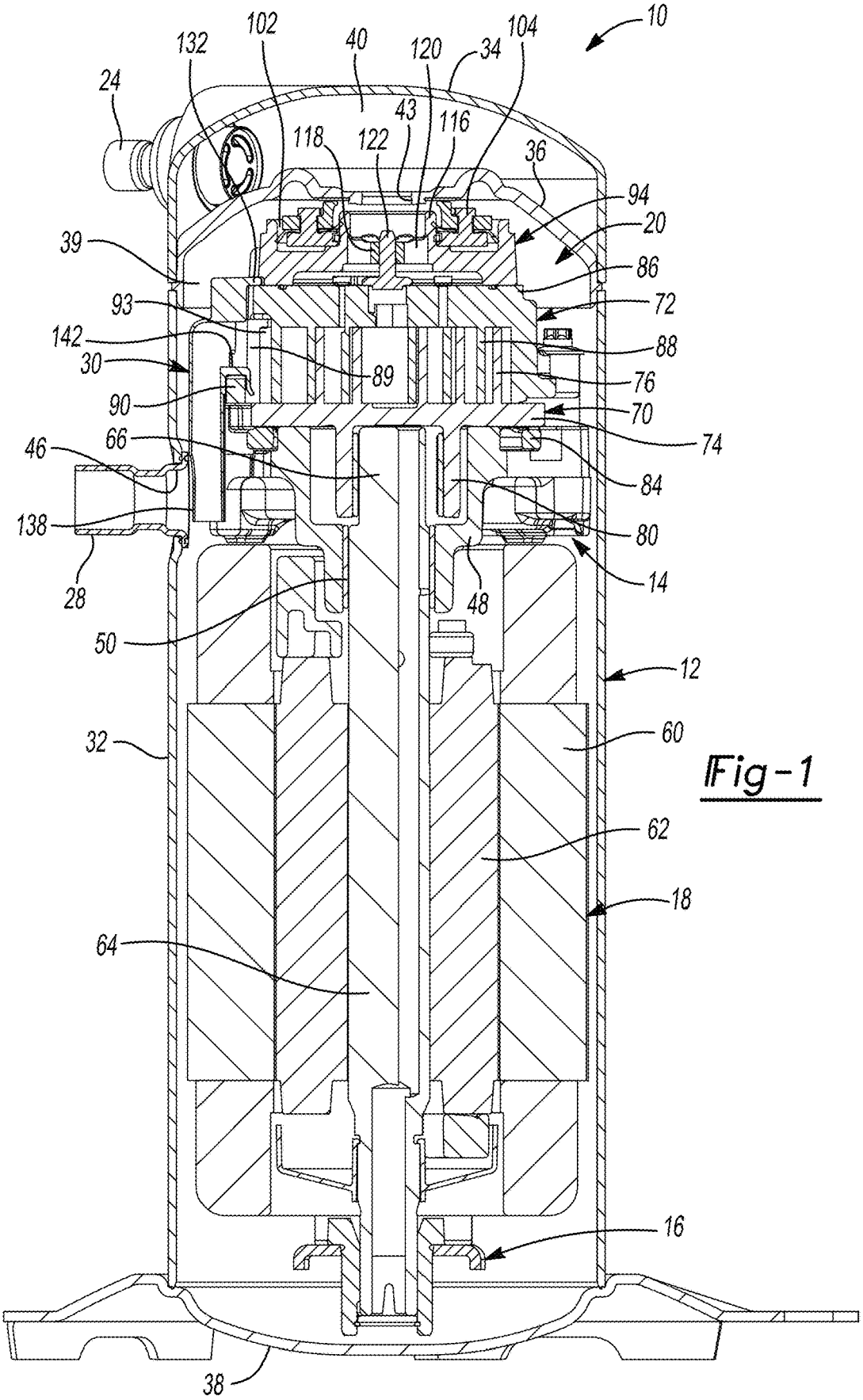
FIG. 1 is a cross-sectional view of a compressor having a suction conduit according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a compressor 10 is provided that may include a hermetic shell assembly 12, first and second bearing housing assemblies 14, 16, a motor assembly 18, a compression mechanism 20, a discharge port or fitting 24, a suction port or fitting 28, and a suction conduit (or suction funnel) 30.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32, the base 38 and the partition 36 may cooperate to define a suction-pressure chamber 39. The end cap 34 and the partition 36 may define a discharge-pressure chamber 40. The partition 36 may separate the discharge-pressure chamber 40 from the suction-pressure chamber 39. A discharge-pressure passage 43 may extend through the partition 36 to provide communication between the compression mechanism 20 and the discharge-pressure chamber 40. The suction fitting 28 may be attached to the shell assembly 12 at an opening 46.

As shown in FIG. 1, the first bearing housing assembly 14 may be disposed within the suction-pressure chamber and may be fixed relative to the shell 32. The first bearing housing assembly 14 may include a first main bearing housing 48 and a first bearing 50. The first main bearing housing 48 may house the first bearing 50 therein. The first main bearing housing 48 may fixedly engage the shell 32 and may axially support the compression mechanism 20.

As shown in FIG. 1, the motor assembly 18 may be disposed within the suction-pressure chamber 39 and may include a stator 60 and a rotor 62. The stator 60 may be press fit into the shell 32. The rotor 62 may be press fit on a drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat.

As shown in FIG. 1, the compression mechanism 20 may be disposed within the suction-pressure chamber 39 and may include an orbiting scroll 70 and a non-orbiting scroll 72. The first scroll member or orbiting scroll 70 may include an end plate 74 and a spiral wrap 76 extending therefrom. A cylindrical hub 80 may project downwardly from the end plate 74. A drive bushing may be disposed in the hub 80 and may receive the crank pin 66. An Oldham coupling 84 may be engaged with the orbiting and non-orbiting scrolls 70, 72 to prevent relative rotation therebetween.

Figure 2:
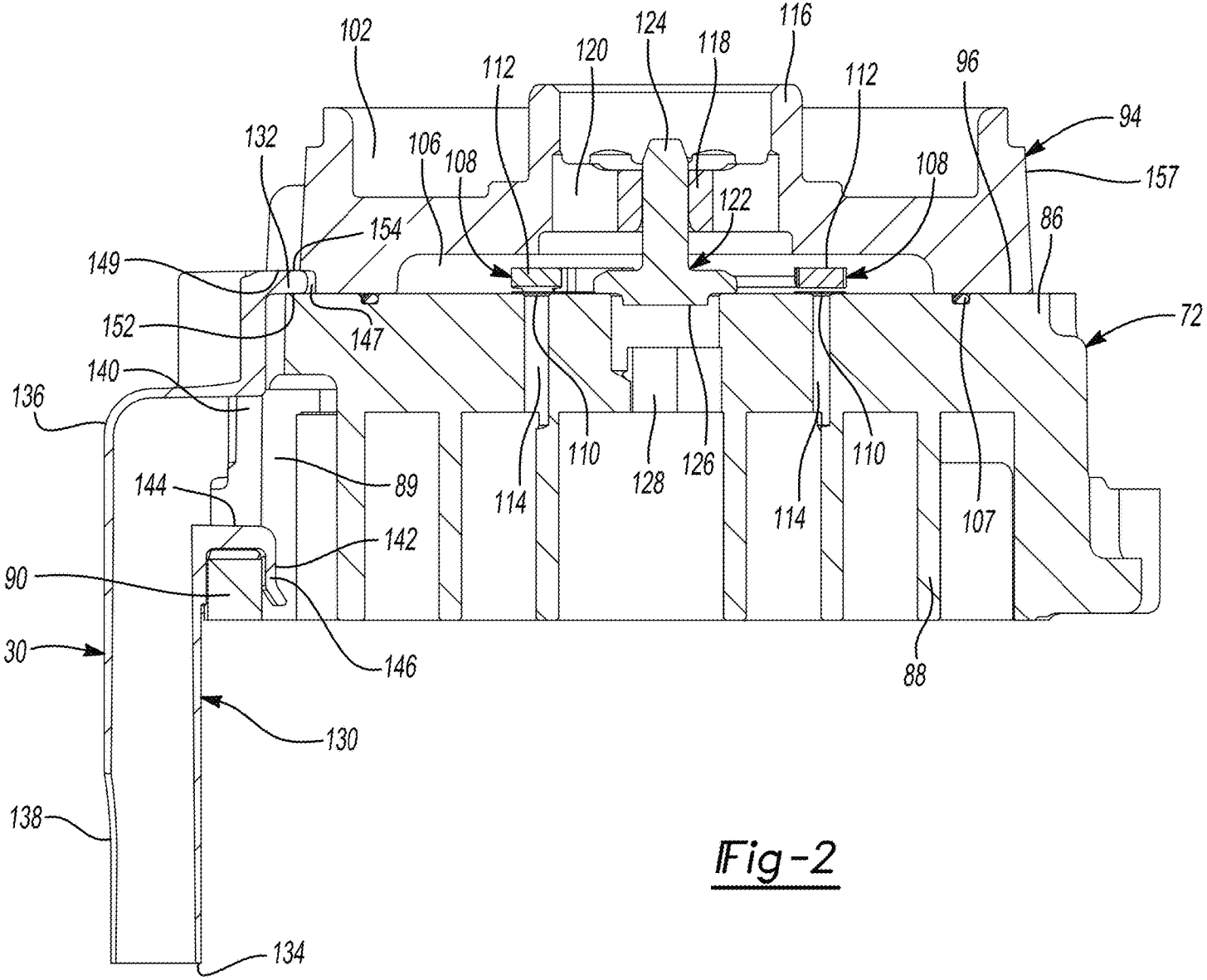
FIG. 2 is a cross-sectional view of a non-orbiting scroll and the suction conduit of the compressor of FIG. 1.
Figure 4:
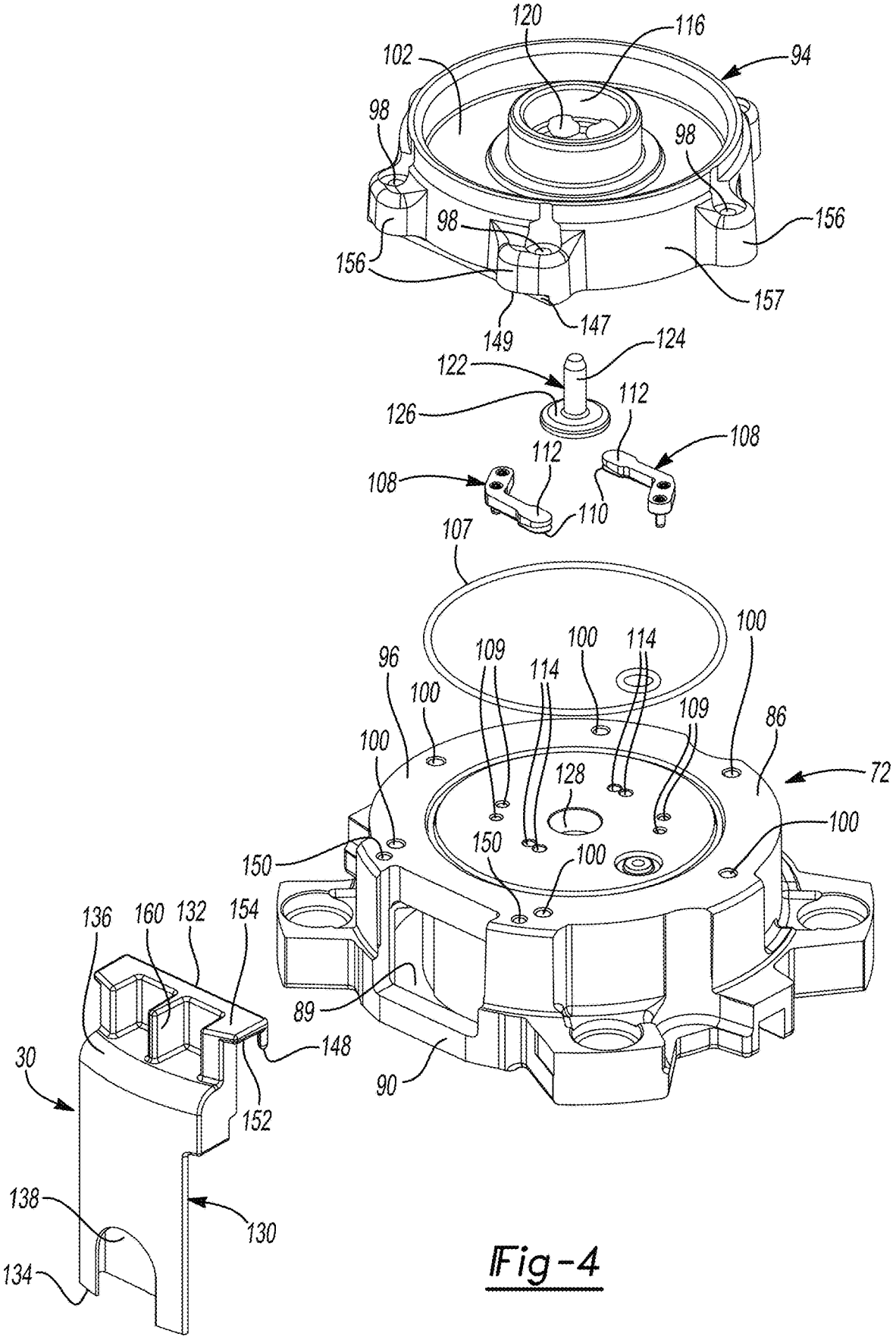
FIG. 4 is an exploded view of the non-orbiting scroll and suction conduit.

As shown in FIG. 1, the second scroll member or non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20. As shown in FIGS. 1, 2, and 4, a suction inlet 89 may be formed in the non-orbiting scroll 72 and may provide fluid communication between the suction conduit 30 and a radially outermost fluid pocket 93 (FIG. 1) formed by the spiral wraps 76, 88.

The non-orbiting scroll 72 may include an upper scroll piece 94 that is mounted to the end plate 86 (lower scroll piece). The upper scroll piece 94 is mounted to an upper surface 96 of the end plate 86. Fasteners (e.g., threaded fasteners) may extend through mounting apertures 98 (FIG. 4) of the upper scroll piece 94 and into mounting apertures 100 (FIG. 4) in the end plate 86. The upper scroll piece 94 may include an upper annular recess 102 that may receive a floating seal assembly 104, as shown in FIG. 1. As will be described in more detail below, a portion of the suction conduit 30 may be captured or clamped (or sandwiched) between the upper scroll piece 94 and the end plate 86.

The upper scroll piece 94 may also include a lower recess 106 (FIG. 2) in which variable-compression-ratio valves 108 may be disposed. Each of the variable-compression-ratio valves 108 may include a valve member (e.g., a reed valve) 110 and a valve backer 112. The valve member 110 is movable relative to the end plate 86 to selectively open and close variable-compression-ratio ports 114 formed in the end plate 86. The variable-compression-ratio ports 114 are in fluid communication with intermediate-pressure pockets formed by the spiral wraps 76, 88. The variable-compression-ratio valves 108 selectively allow and prevent fluid communication between the intermediate-pressure pockets and the discharge chamber 40. The variable-compression-ratio valves 108 may be mounted to the end plate 86 by fasteners (e.g., pins or threaded fasteners) that engage apertures 109 (FIG. 4) in the end plate 86. A seal (e.g., O-ring) 107 may encircle the lower recess 106 and may sealingly engage the end plate 86 and upper scroll piece 94.

As shown in FIG. 2, the upper scroll piece 94 may also include a central hub 116 that may define a valve guide 118 and one or more apertures 120. The apertures 120 may be in fluid communication with the lower recess 106 and the discharge chamber 40. The valve guide 118 may movably engage (and guide movement of) a portion of a discharge valve 122. For example, the valve guide 118 may include an aperture that reciprocatingly receives a stem 124 of the discharge valve 122. A body 126 of the discharge valve 122 may selectively open and close a discharge passage 128 formed in the end plate 86 to selectively allow and prevent fluid communication between the discharge passage 128 and the discharge chamber 40. The discharge passage 128 receives fluid from a discharge-pressure pocket formed by the spiral wraps 76, 88.

The suction conduit 30 may direct working fluid at a suction-pressure from the suction fitting 28 to the suction inlet 89 of the non-orbiting scroll 72 so that working fluid can be directed into the radially outermost fluid pocket 93 and subsequently compressed by the compression mechanism 20. As shown in FIGS. 1, 2 and 4, a portion of the suction conduit 30 may snap into engagement with a wall 90 of the non-orbiting scroll 72 (e.g., a wall that defines a lower end of the suction inlet 89) and another portion of the suction conduit 30 may be captured or clamped between the upper scroll piece 94 and the end plate 86. The suction conduit 30 may include a body 130 and a mounting flange 132. The body 130 may include a first end 134 and a second end 136. An inlet opening 138 (FIGS. 3-5) may be formed at or near the first end 134 of the body 130 and an outlet opening 140 (FIGS. 2 and 6) may be formed at or near the second end 136 of the body 130. The first end 134 may be adjacent to the suction fitting 28 such that fluid may flow from the suction fitting 28 into the inlet opening 138. In some configurations, the inlet opening 138 may be generally aligned with the suction fitting 28. In some configurations, the first end 134 may be open (or include an aperture) to allow a portion of the working fluid from the suction fitting 28 to flow toward the motor assembly 18 (rather than toward the suction inlet 89.

The outlet opening 140 may provide fluid communication between the suction conduit 30 and the compression mechanism 20. That is, working fluid that flows into the suction conduit 30 through the inlet opening 138 may exit the suction conduit 30 through the outlet opening 140. From the outlet opening 140, the working fluid may be directed into the radially outermost fluid pocket 93 and subsequently compressed by the compression mechanism 20.

Figure 6:
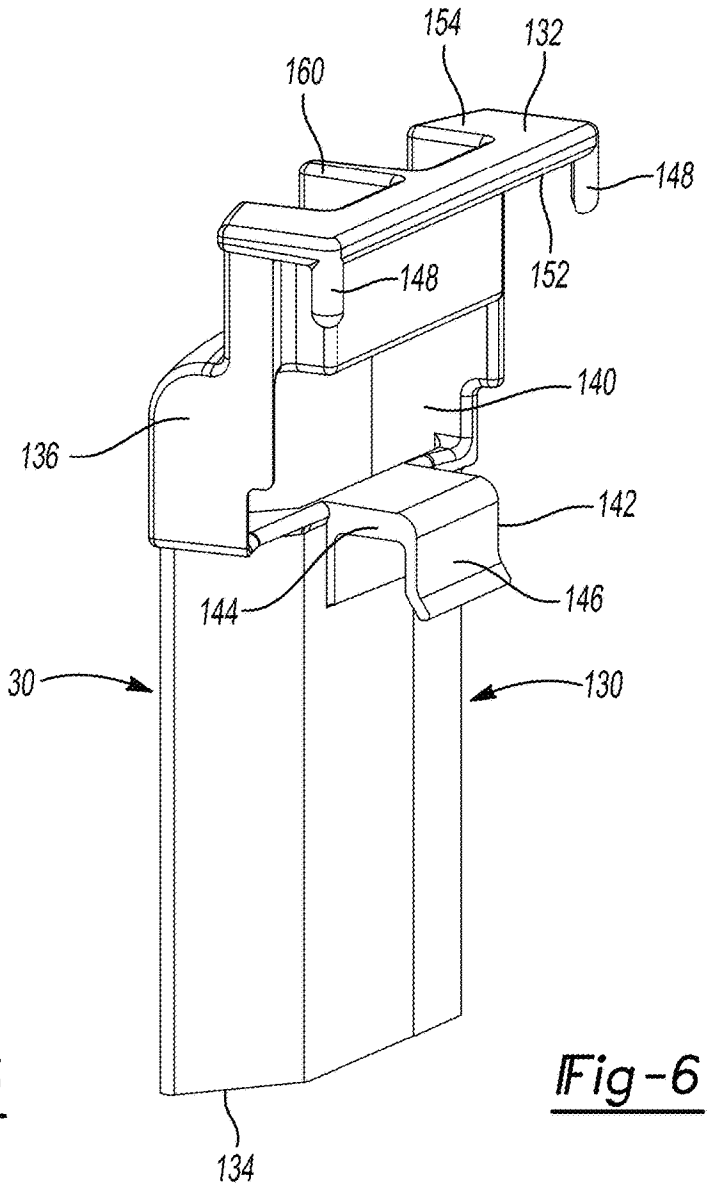
FIG. 6 is another perspective view of the suction conduit.

A mounting tab or clip 142 (FIGS. 1, 2 and 6) may extend from the body 130 and may be disposed at or near a bottom of the outlet opening 140. As shown in FIGS. 2 and 6, the clip 142 may include a first member 144 and a second member 146 extending perpendicularly to the first member 144. When the suction conduit 30 snaps into engagement with the non-orbiting scroll 72, the clip 142 may extend at least partially into the suction inlet 89 and engage the wall 90 (i.e., the clip 144 may snap onto the wall 90).

Figure 3:
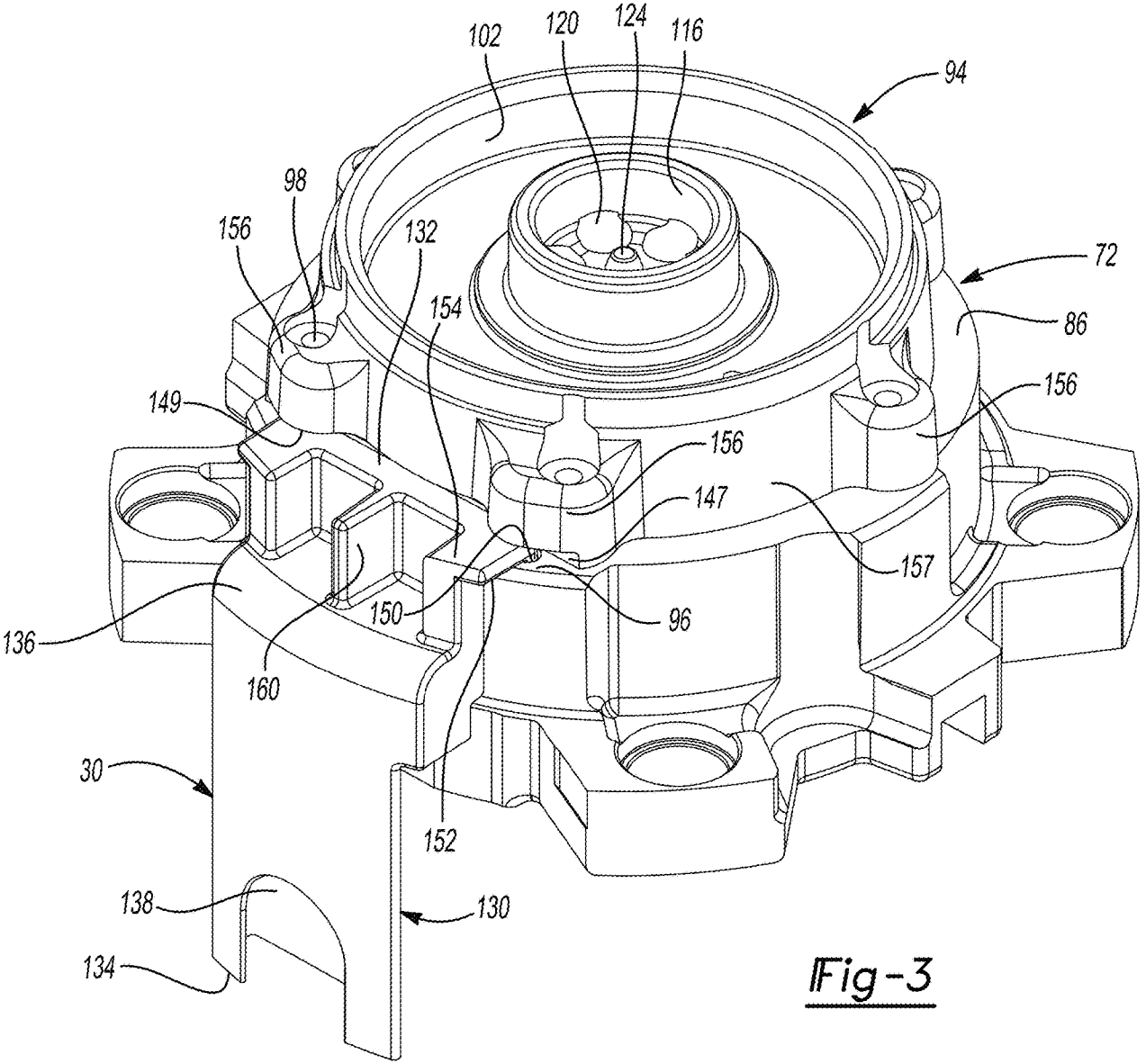
FIG. 3 is a perspective view of the non-orbiting scroll and suction conduit.
Figure 5:
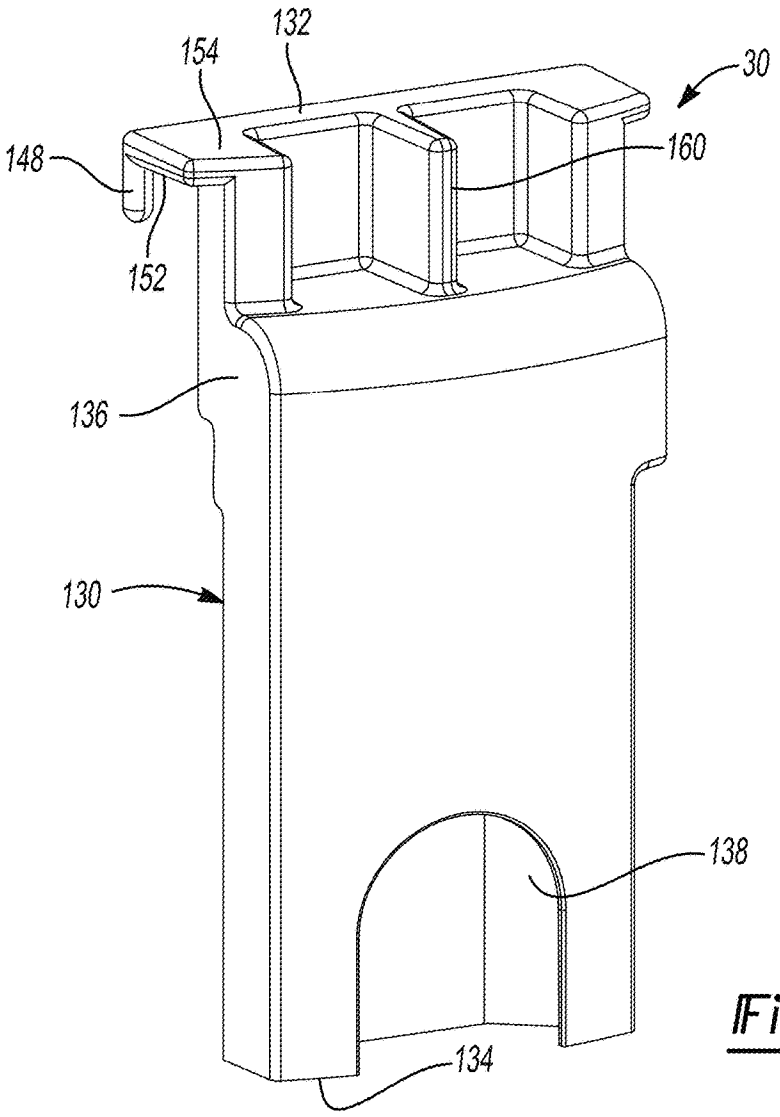
FIG. 5 is a perspective view of the suction conduit.
Figure 7:
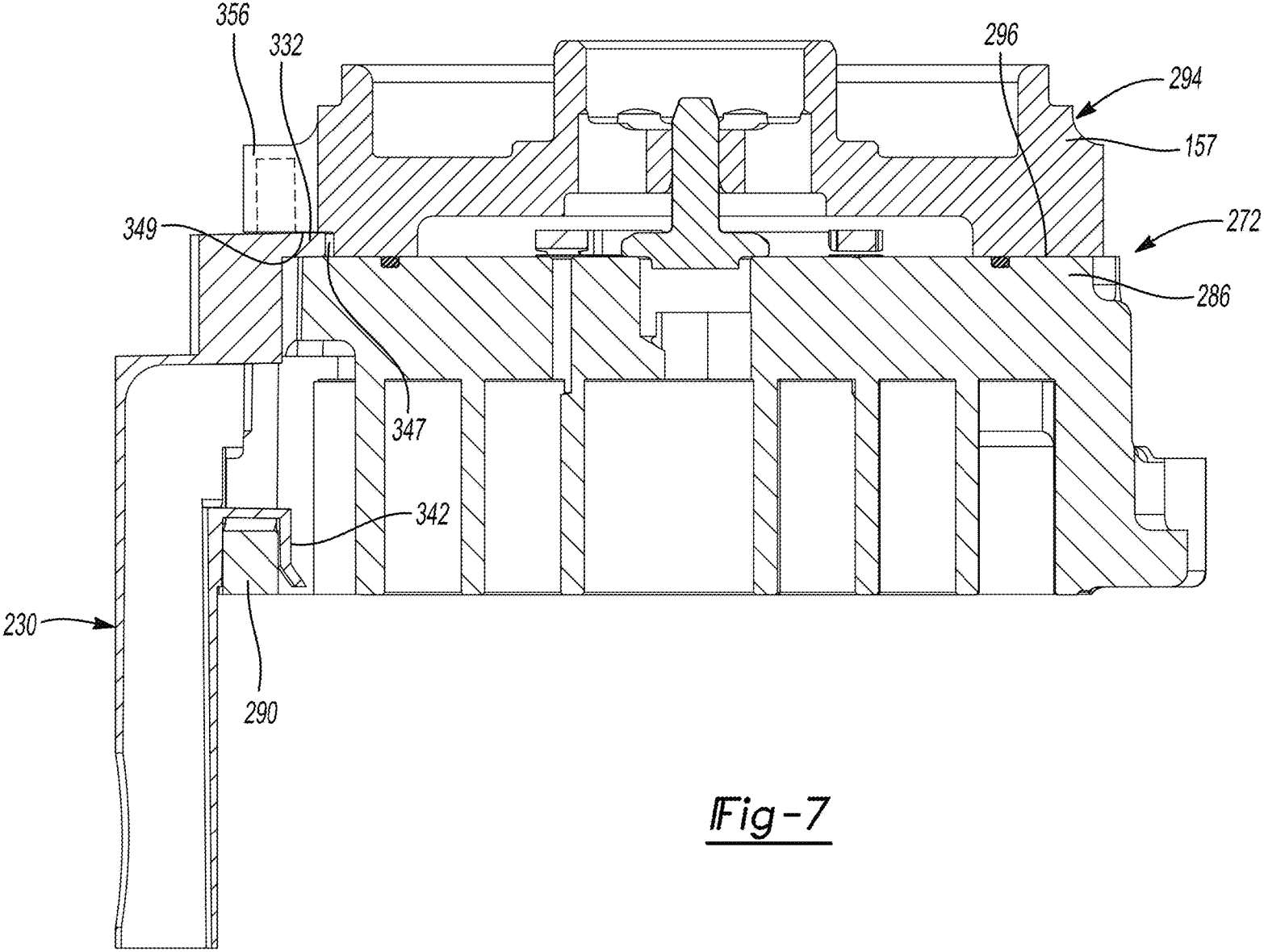
FIG. 7 is a cross-sectional view of another non-orbiting scroll and another suction conduit according to the principles of the present disclosure.
Figure 8:
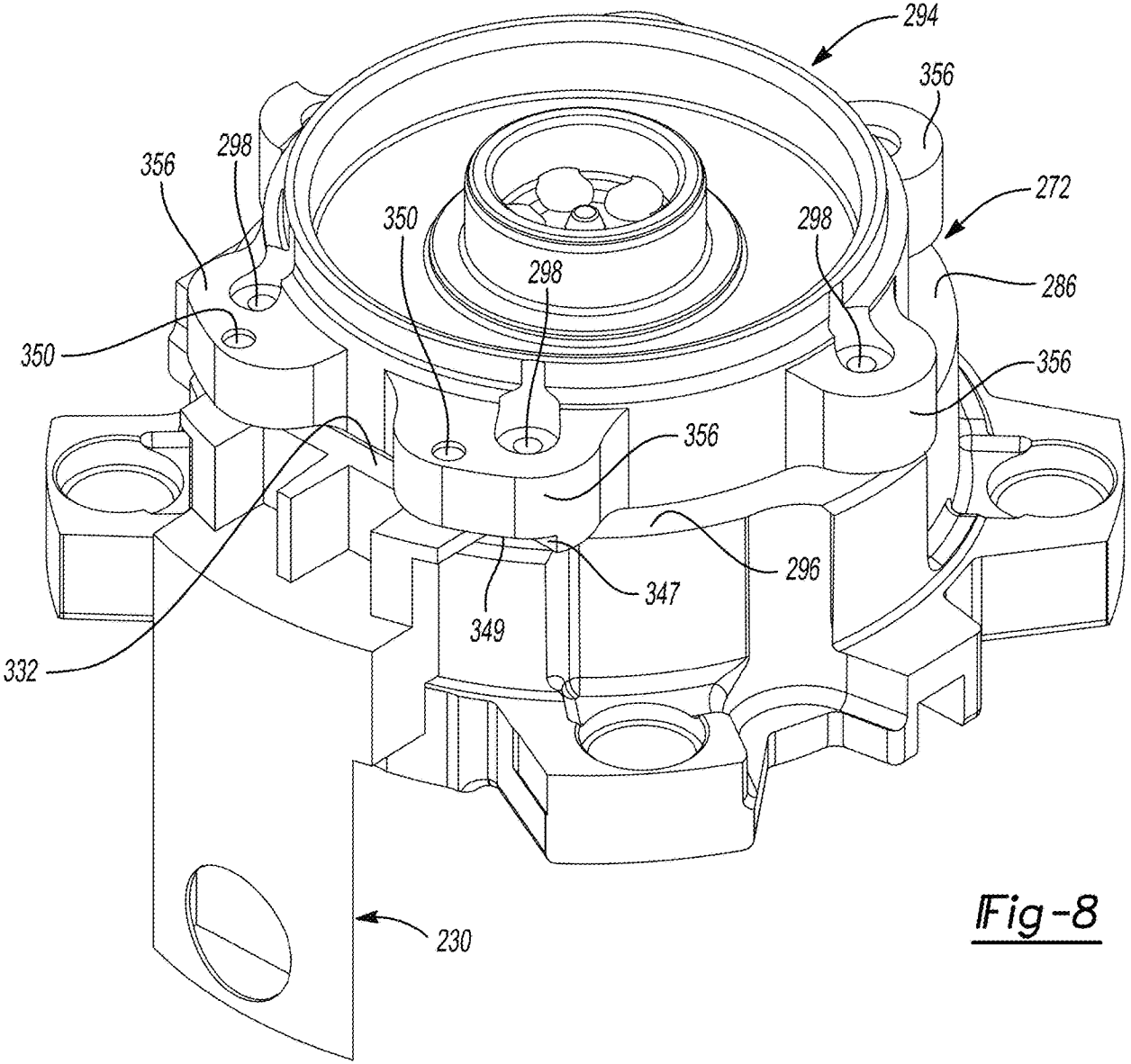
FIG. 8 is a perspective view of the non-orbiting scroll and conduit of FIG. 7.
Figure 9:
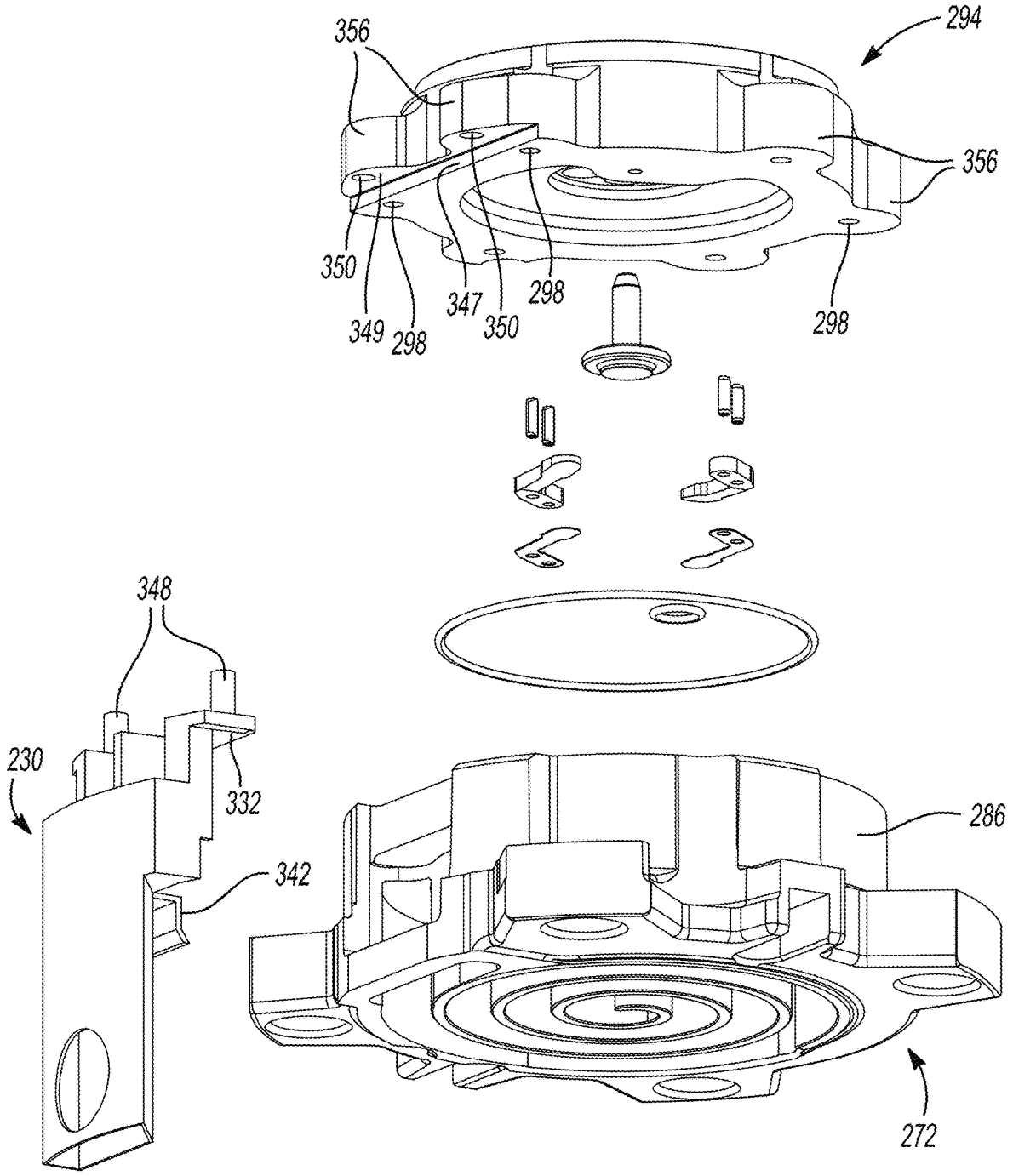
FIG. 9 is an exploded view of the non-orbiting scroll and conduit of FIG. 7.
Figure 10:
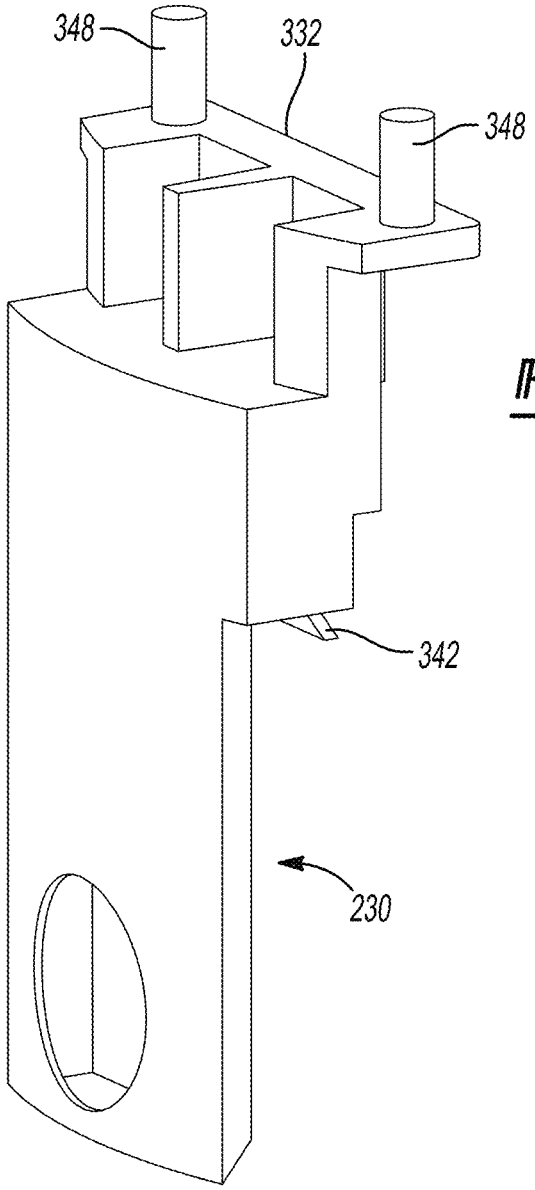
FIG. 10 is a perspective view of the suction conduit of FIG. 7.
Figure 11:
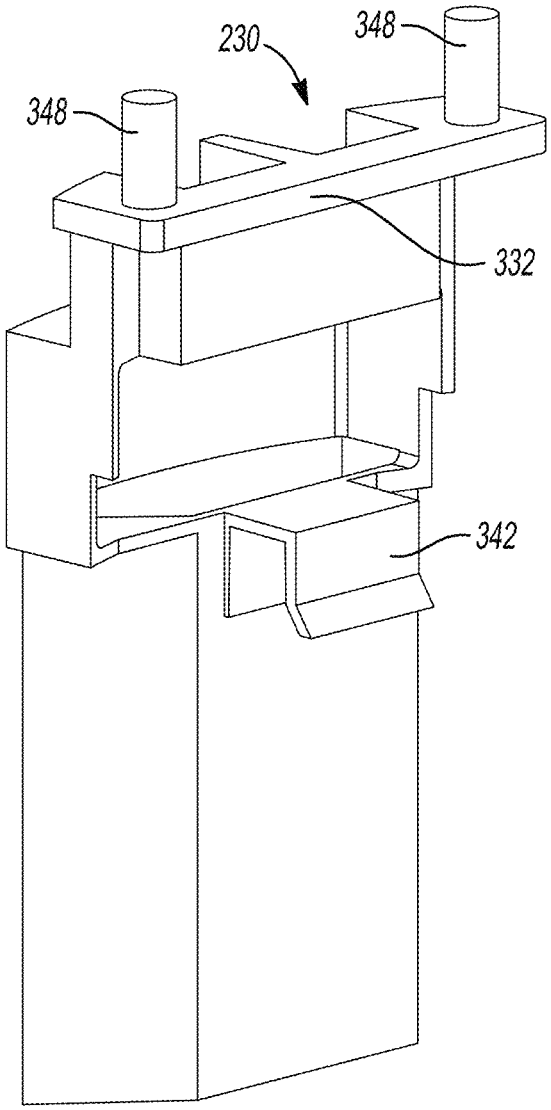
FIG. 11 is another perspective view of the suction conduit of FIG. 7.
Figure 12:
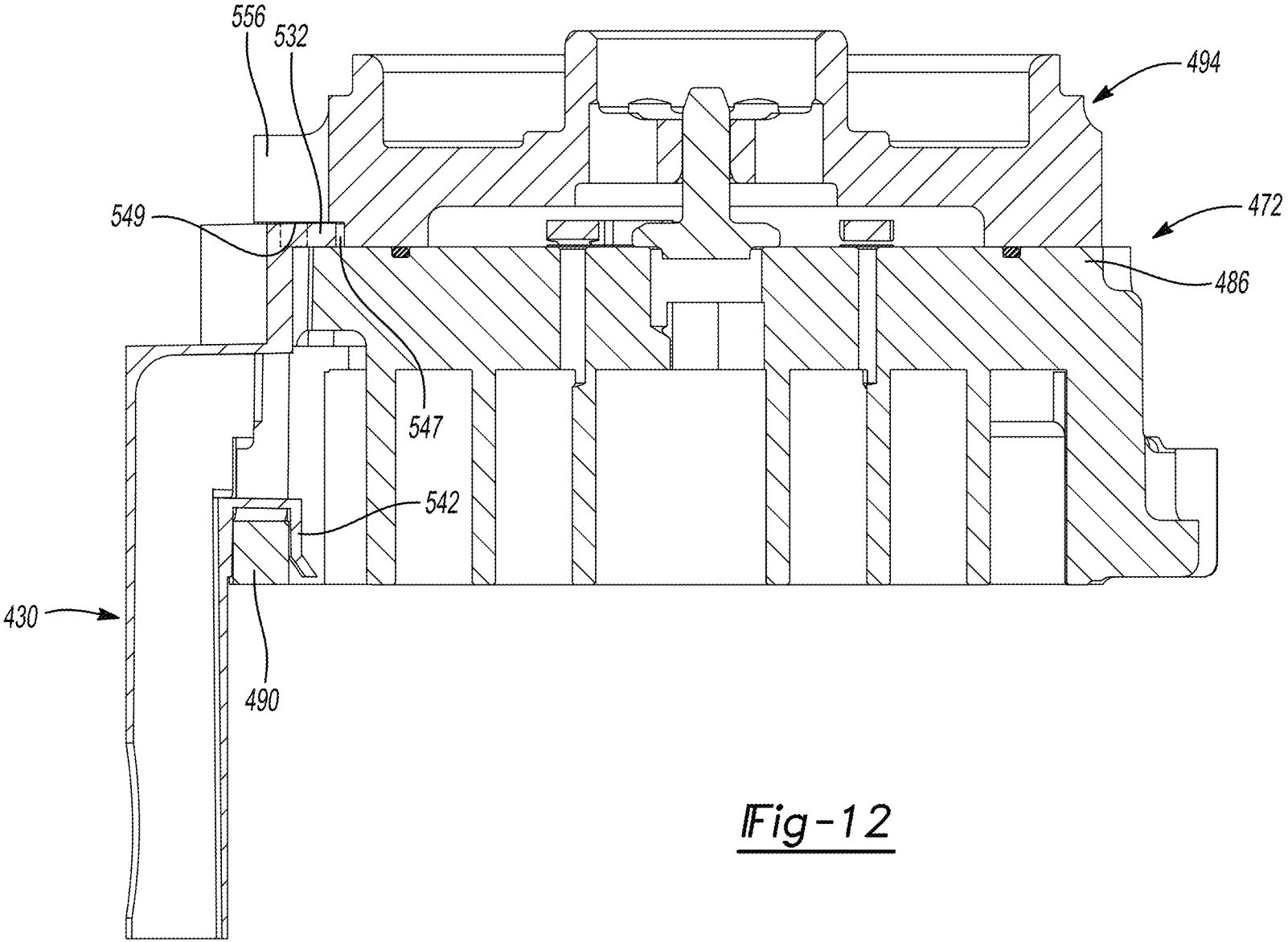
FIG. 12 is a cross-sectional view of another non-orbiting scroll and another suction conduit according to the principles of the present disclosure.
Figure 13:
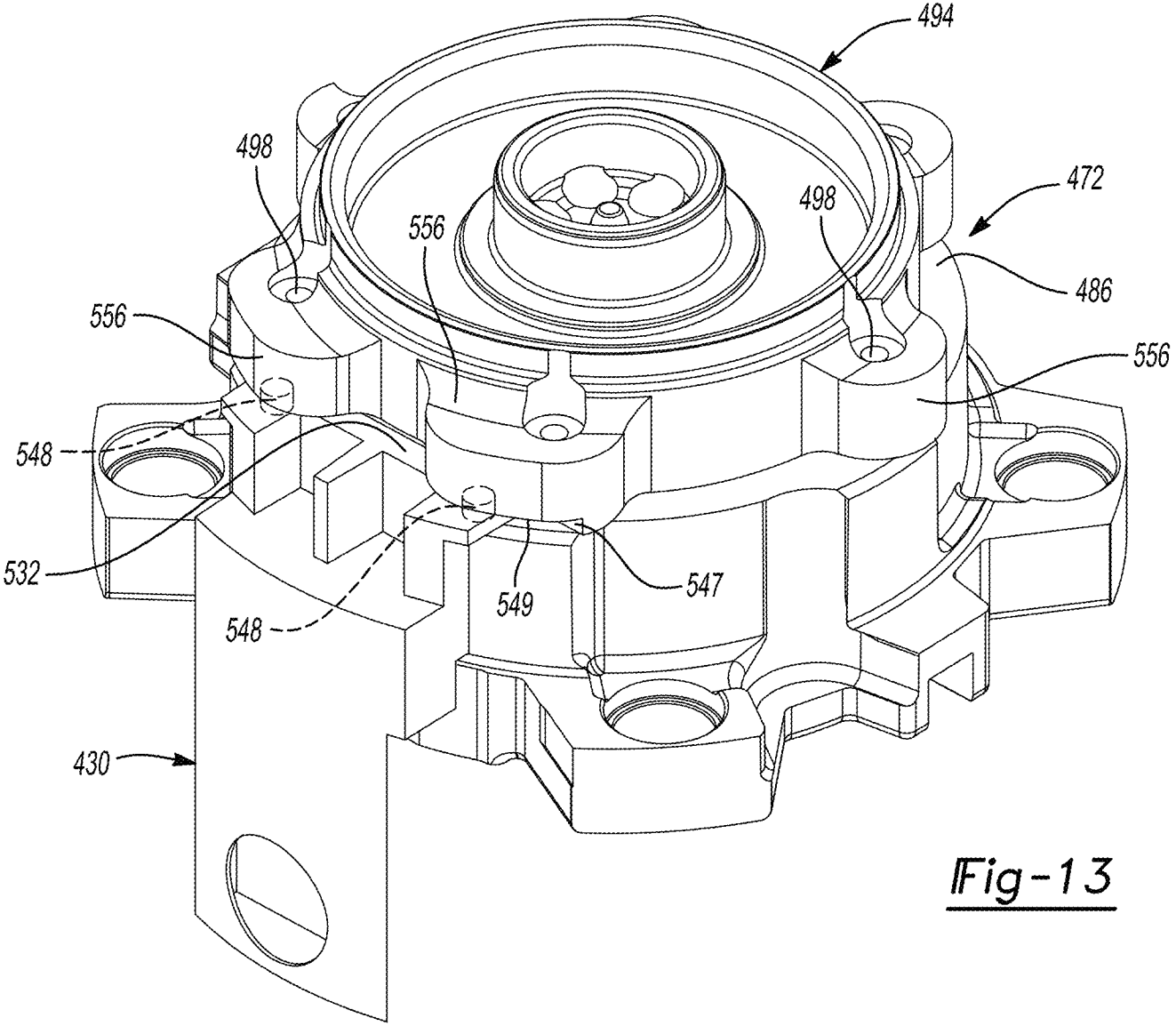
FIG. 13 is a perspective view of the non-orbiting scroll and conduit of FIG. 12.
Figure 14:
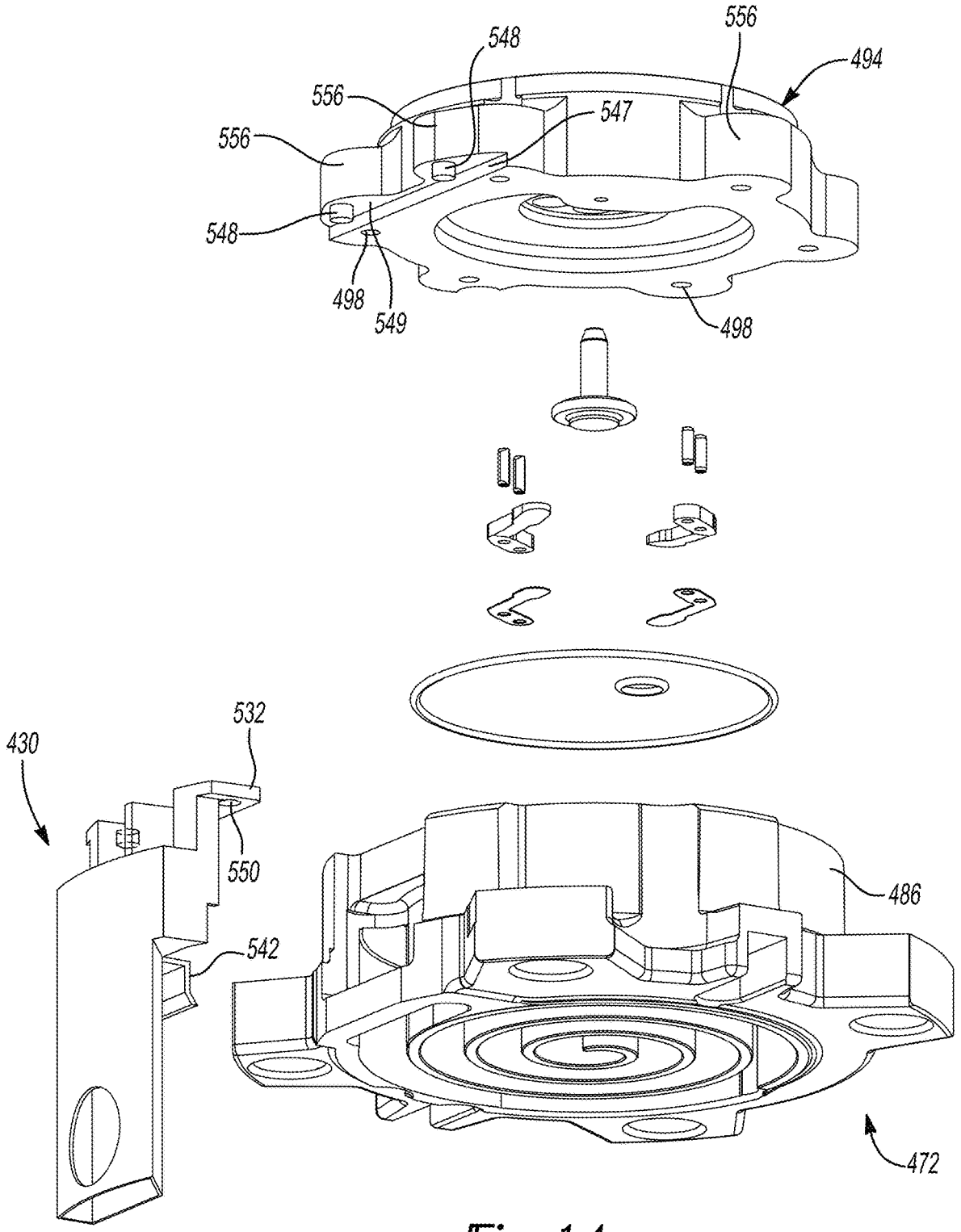
FIG. 14 is an exploded view of the non-orbiting scroll and conduit of FIG. 12.
Figure 15:
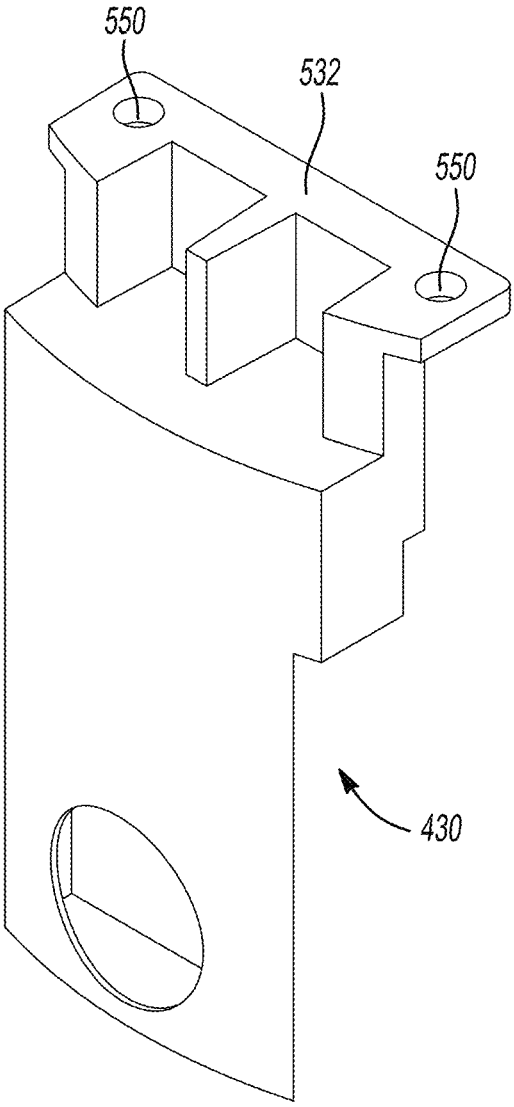
FIG. 15 is a perspective view of the suction conduit of FIG. 12.
Figure 16:
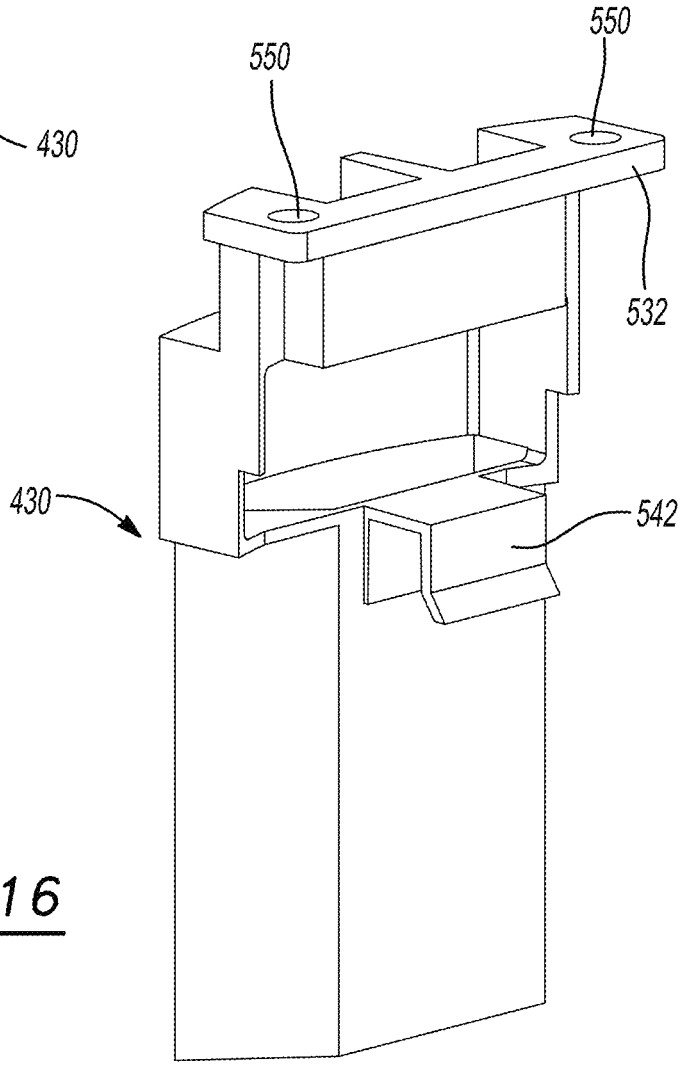
FIG. 16 is another perspective view of the suction conduit of FIG. 12.

The mounting flange 132 may extend from the second end 136 of the body 130 and may be disposed at or near a top of the outlet opening 140. The mounting flange 132 may be received in a recess (or notch) 147 formed in a lower side of the upper scroll piece 94 such that a surface 149 defining the recess 147 may contact the mounting flange 132, as shown in FIGS. 2 and 3. As shown in FIGS. 4-6, the mounting flange 132 may include one or more locating pins (or protrusions) 148 extending therefrom. The locating pins 148 may be received in apertures (or openings) 150 formed in the non-orbiting scroll 72. In the example shown in FIGS. 1-6, the apertures 150 that receive the locating pins 148 are formed in the end plate 86.

When the suction conduit 30 is fully mounted to the non-orbiting scroll 72, the clip 142 is engaged with the wall 90 (as described above), the locating pins 148 are received in apertures 150, a lower surface 152 of the mounting flange 132 is in contact with the surface 96 of the end plate 86, and an upper surface 154 of the mounting flange 132 is in contact with the upper scroll piece 94 (e.g., the surface 149) such that the mounting flange 132 is captured (or clamped) between the upper scroll piece 94 and the end plate 86. This mounting configuration for the suction conduit 30 securely retains the suction conduit 30 relative to the non-orbiting scroll 72 in a manner that is simple to install. In this manner, while the mounting flange 132 is captured or clamped between the upper scroll piece 94 and the end plate 86, the engagement between the pins 148 and the apertures 150 restricts or prevents the suction conduit 30 from being inadvertently disengaged from the non-orbiting scroll 72.

In some configurations, the surface 149 of the upper scroll piece 94 that contacts the mounting flange 132 may be defined by (or partially defined by) one or more mounting lobes 156 (FIGS. 3 and 4) of the upper scroll piece 94. The mounting lobes 156 are circumferentially spaced apart from each other and may extend radially outward from an outer rim 157 of the upper scroll piece 94. The mounting lobes 156 may include the mounting apertures 98 through which fasteners may extend to secure the upper scroll piece 94 to the end plate 86, as described above.

In some configurations, the suction conduit 30 may include one or more ribs 160 that extend from the second end 136 of the body 130 to the mounting flange 132. The one or more ribs 160 provide rigidity and strength for the suction conduit 30 and may also provide a convenient location for an operator to grasp the suction conduit 30 during installation onto the non-orbiting scroll 72.

Referring now to FIGS. 7-11, another non-orbiting scroll 272 and suction conduit 230 are provided. The non-orbiting scroll 272 and suction conduit 230 may be incorporated into the compressor 10 described above instead of the non-orbiting scroll 72 and suction conduit 30. The structure and function of the non-orbiting scroll 272 and suction conduit 230 may be similar or identical to that of the non-orbiting scroll 72 and suction conduit 30 described above apart from differences described below.

Like the non-orbiting scroll 72, the non-orbiting scroll 272 includes a lower scroll piece or end plate 286 and an upper scroll piece 294. Like the upper scroll piece 94, the upper scroll piece 294 includes a recess (or notch) 347 including a surface 349. As described above, a mounting flange 332 of the suction conduit 230 may be received in the recess 347 so that the mounting flange 332 may be captured or clamped between the surface 349 of the upper scroll piece 294 and an upper surface 296 of the end plate 286.

As described above, the surface 349 of the upper scroll piece 294 that contacts the mounting flange 332 and may be defined by (or partially defined by) one or more mounting lobes 356 of the upper scroll piece 294. The mounting lobes 356 may include mounting apertures 298 through which fasteners may extend to secure the upper scroll piece 294 to the end plate 286, as described above. In the configuration shown in FIGS. 7-9, the mounting lobes 356 that define the surface 349 may also include apertures (or openings) 350 (FIGS. 8 and 9) that receive locating pins (or protrusions) 348 extending from the mounting flange 332 of the suction conduit 230. In this manner, while the mounting flange 332 is captured or clamped between the upper scroll piece 294 and the end plate 286, the engagement between the pins 348 and the apertures 350 restricts or prevents the suction conduit 230 from being inadvertently disengaged from the non-orbiting scroll 272. Like the suction conduit 30, the suction conduit 230 may include a mounting tab or clip 342 that engages a wall 290 of the end plate 286 to further secure the suction conduit 230 to the non-orbiting scroll 272.

Referring now to FIGS. 12-16, another non-orbiting scroll 472 and suction conduit 430 are provided. The non-orbiting scroll 472 and suction conduit 430 may be incorporated into the compressor 10 described above instead of the non-orbiting scroll 72, 272 and suction conduit 30, 230. The structure and function of the non-orbiting scroll 472 and suction conduit 430 may be similar or identical to that of the non-orbiting scroll 272 and suction conduit 230 described above apart from differences described below.

Like the non-orbiting scroll 272, the non-orbiting scroll 472 includes a lower scroll piece or end plate 486 and an upper scroll piece 494. Like the upper scroll piece 294, the upper scroll piece 494 includes a recess (or notch) 547 including a surface 549. As described above, a mounting flange 532 of the suction conduit 430 may be received in the recess 547 so that the mounting flange 532 may be captured or clamped between the surface 549 of the upper scroll piece 494 and an upper surface 496 of the end plate 486. Like the suction conduit 230, the suction conduit 430 may include a mounting tab or clip 542 that engages a wall 490 of the end plate 486.

As described above, the surface 549 of the upper scroll piece 494 that contacts the mounting flange 532 may be defined by (or partially defined by) one or more mounting lobes 556 of the upper scroll piece 494. The mounting lobes 556 may include mounting apertures 498 (FIGS. 13 and 14) through which fasteners may extend to secure the upper scroll piece 494 to the end plate 486, as described above. In the configuration shown in FIGS. 12-16, the mounting lobes 556 that define the surface 549 may also include locating pins (or protrusions) 548 (FIG. 14) that are received in apertures (or openings) 550 formed in the mounting flange 532 of the suction conduit 430. In this manner, while the mounting flange 532 is captured or clamped between the upper scroll piece 494 and the end plate 486, the engagement between the pins 548 and the apertures 550 restricts or prevents the suction conduit 630 from being inadvertently disengaged from the non-orbiting scroll 672.

In some configurations, the apertures 550 in the mounting flange 532 may be aligned with respective mounting apertures 498 in the upper scroll piece 494 and mounting apertures in the end plate 486. In such configurations, pins 548 may be replaced with fasteners (e.g., threaded fasteners) that extend through the apertures 498, 550 and into the mounting apertures in the end plate 486.

Referring now to FIGS. 17-22, another non-orbiting scroll 672 and suction conduit 630 are provided. The non-orbiting scroll 672 and suction conduit 630 may be incorporated into the compressor 10 described above instead of the non-orbiting scroll 72, 272, 472 and suction conduit 30, 230, 430. The structure and function of the non-orbiting scroll 672 and suction conduit 630 may be similar or identical to that of the non-orbiting scroll 72, 272, 472 and suction conduit 30, 230, 430 described above apart from differences described below.

Figure 20:
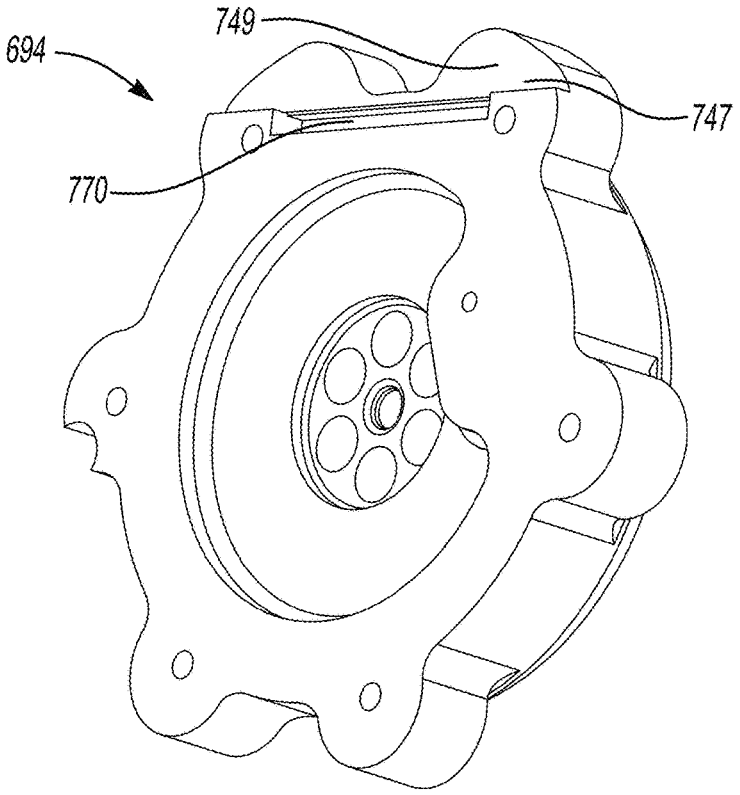
FIG. 20 is a perspective view of an upper scroll piece of the non-orbiting scroll of FIG. 17.
Figure 21:
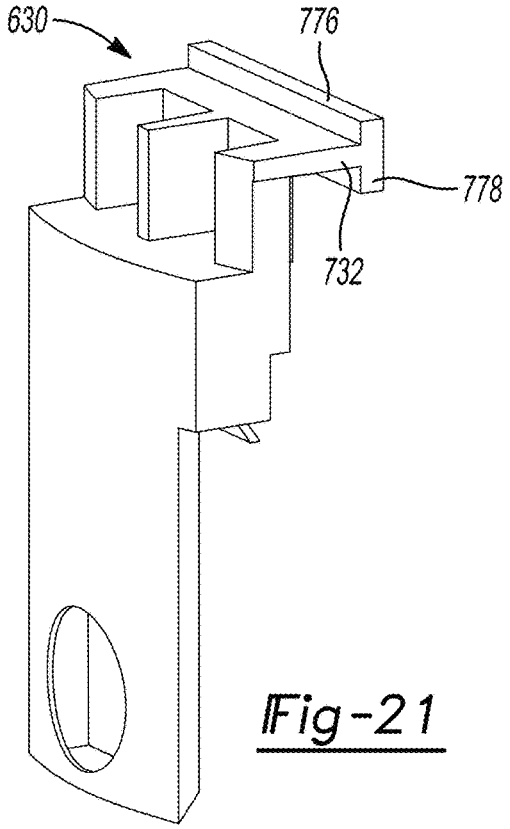
FIG. 21 is a perspective view of the suction conduit of FIG. 17.
Figure 22:
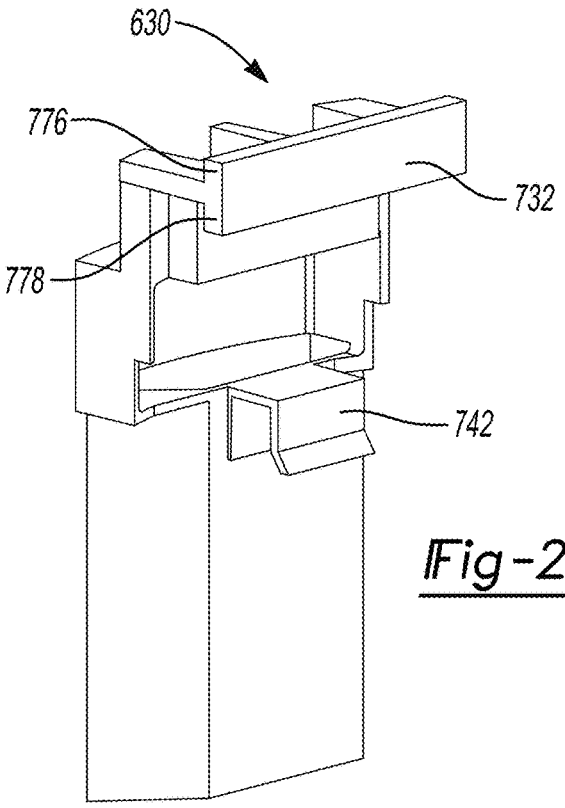
FIG. 22 is another perspective view of the suction conduit of FIG. 17.

Like the non-orbiting scroll 72, the non-orbiting scroll 672 includes a lower scroll piece or end plate 686 and an upper scroll piece 694. Like the upper scroll piece 94, the upper scroll piece 694 includes a recess (or notch) 747 including a surface 749 (as shown in FIG. 20). As described above, a mounting flange 732 of the suction conduit 630 may be received in the recess 747 so that the mounting flange 732 may be captured or clamped between the surface 749 of the upper scroll piece 694 and an upper surface 696 of the end plate 686. Like the suction conduit 30, the suction conduit 630 may include a mounting tab or clip 742 that engages a wall 690 of the end plate 686.

Figure 17:
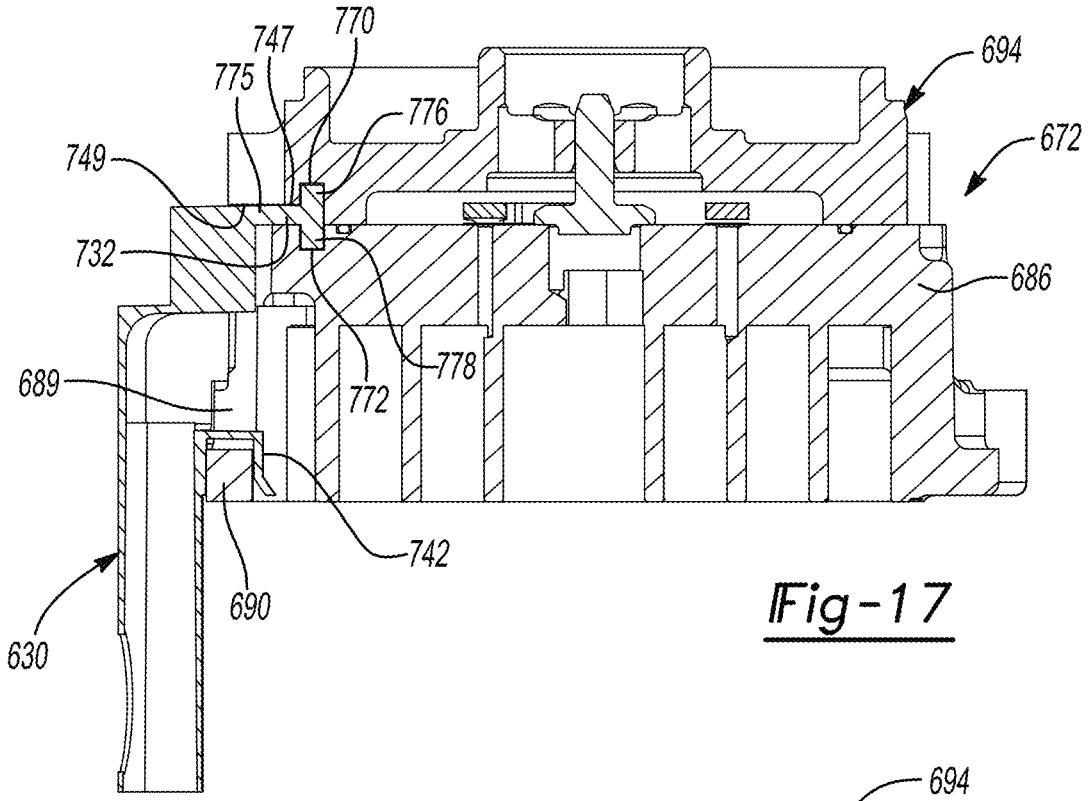
FIG. 17 is a cross-sectional view of another non-orbiting scroll and another suction conduit according to the principles of the present disclosure.
Figure 18:
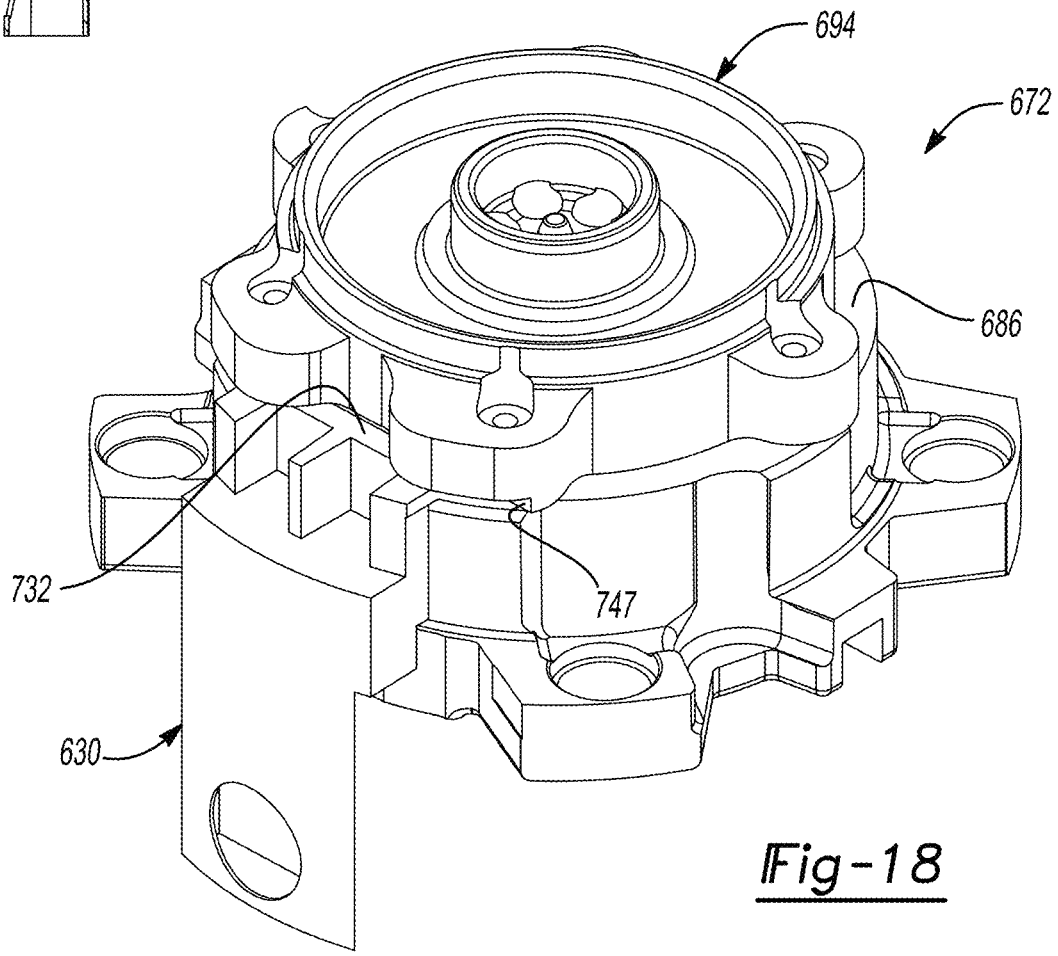
FIG. 18 is a perspective view of the non-orbiting scroll and conduit of FIG. 17.
Figure 19:
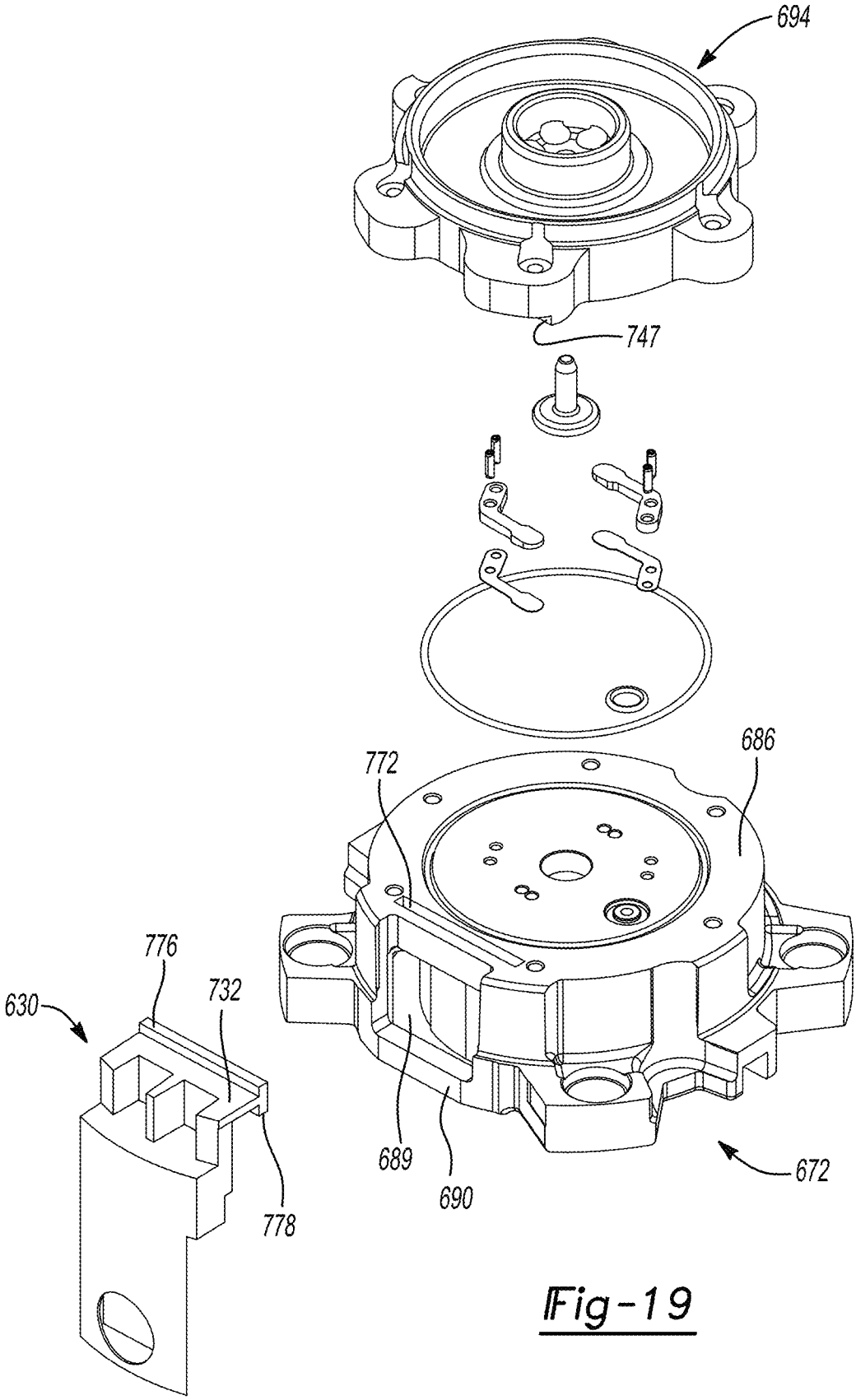
FIG. 19 is an exploded view of the non-orbiting scroll and conduit of FIG. 17.

As shown in FIGS. 17 and 20, the upper scroll piece 694 may include a slot (or opening) 770 disposed adjacent to the recess 747. As shown in FIGS. 17 and 19, the end plate 686 may also include a slot (or opening) 772 disposed adjacent to a suction inlet 689 of the non-orbiting scroll 672. As shown in FIG. 17, the slots 770, 772 may be generally aligned with each other when the upper scroll piece 694 is mounted on the end plate 686.

A distal end of the mounting flange 732 may include a first protrusion or lip 776 and a second protrusion or lip 778. The first lip 776 may extend upward from the mounting flange 732 and may be received in the slot 770 in the upper scroll piece 694 (as shown in FIG. 17). The second lip 778 may extend downward from the mounting flange 732 and may be received in the slot 772 in the end plate 686 (as shown in FIG. 17). In this manner, while the mounting flange 732 is captured or clamped between the upper scroll piece 694 and the end plate 686, the engagement between the lips 776, 778 and the slots 770, 772, respectively, restricts or prevents the suction conduit 630 from being inadvertently disengaged from the non-orbiting scroll 672. As shown in FIG. 17, the lips 776, 778 and a main body 775 of the mounting flange 732 cooperate to form a T-shaped cross section.

The foregoing description of the embodiments has been provided for purposes of illustration and description. It is not intended to be exhaustive or to limit the disclosure. Individual elements or features of a particular embodiment are generally not limited to that embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

an orbiting scroll;

a non-orbiting scroll meshingly engaged with the orbiting scroll and including a lower scroll piece and an upper scroll piece that is mounted to the lower scroll piece, wherein the lower scroll piece includes a discharge passage through which discharge-pressure gas flows, and wherein the upper scroll piece includes an aperture in fluid communication with the discharge passage; and a suction conduit mounted to the non-orbiting scroll, wherein the suction conduit includes an inlet, an outlet, and a mounting flange, wherein the outlet is disposed adjacent to and in fluid communication with a suction inlet of the non-orbiting scroll, and wherein at least a portion of the mounting flange is captured between the upper and lower scroll pieces.

2. The compressor of claim 1, wherein the mounting flange includes a protrusion that is received in an opening in one of the upper and lower scroll pieces.

3. The compressor of claim 2, wherein the protrusion is a pin and the opening is formed in the lower scroll piece.

4. The compressor of claim 2, wherein the protrusion is a pin and the opening is formed in the upper scroll piece.

5. The compressor of claim 2, wherein the protrusion is a lip extending in a first direction from the mounting flange, wherein the opening is a slot formed in the upper scroll piece, and wherein another lip extends from the mounting flange in a second direction opposite the first direction and is received in a slot formed in the lower scroll piece.

6. The compressor of claim 5, wherein the lips and a main body of the mounting flange cooperate to form a T-shaped cross section.

7. The compressor of claim 1, wherein one of the upper and lower scroll pieces includes a protrusion that is received in an opening in the mounting flange.

8. The compressor of claim 1, wherein the suction conduit includes a mounting clip engaging the lower scroll piece of the non-orbiting scroll.

9. The compressor of claim 8, wherein the mounting clip engages a wall of the lower scroll piece that is adjacent to the suction inlet of the non-orbiting scroll.

10. The compressor of claim 1, wherein the upper scroll piece includes a plurality of mounting lobes that are circumferentially spaced apart from each other and extend radially outward from an outer rim of the upper scroll piece, and wherein one or more of the mounting lobes contacts the mounting flange.

11. The compressor of claim 1, wherein the mounting flange is sandwiched between the upper and lower scroll pieces.

12. A compressor comprising:

an orbiting scroll;

a non-orbiting scroll including a first scroll piece and a second scroll piece that is mounted to the first scroll piece, wherein the first scroll piece includes a spiral wrap that is meshingly engaged with a spiral wrap of the orbiting scroll, and wherein a valve disposed between the first and second scroll pieces; and a suction conduit mounted to the non-orbiting scroll, wherein the suction conduit includes an inlet and an outlet, wherein the outlet is disposed adjacent to and in fluid communication with a suction inlet of the non-orbiting scroll, and wherein at least a portion of the suction conduit is sandwiched between the first and second scroll pieces and clamped by the first and second scroll pieces.

13. The compressor of claim 12, wherein the suction conduit includes a protrusion that is received in an opening in one of the first and second scroll pieces.

14. The compressor of claim 13, wherein the protrusion is a pin and the opening is formed in the first scroll piece.

15. The compressor of claim 13, wherein the protrusion is a pin and the opening is formed in the second scroll piece.

16. The compressor of claim 13, wherein the protrusion is a lip extending in a first direction from a mounting flange of the suction conduit, wherein the opening is a slot formed in the second scroll piece, and wherein another lip extends from the mounting flange in a second direction opposite the first direction and is received in a slot formed in the first scroll piece.

17. The compressor of claim 16, wherein the lips and a main body of the mounting flange cooperate to form a T-shaped cross section.

18. The compressor of claim 12, wherein one of the first and second scroll pieces includes a protrusion that is received in an opening in the suction conduit.

19. The compressor of claim 12, wherein the suction conduit includes a mounting clip engaging the first scroll piece of the non-orbiting scroll.

20. The compressor of claim 19, wherein the mounting clip engages a wall of the first scroll piece that is adjacent to the suction inlet of the non-orbiting scroll.

21. The compressor of claim 12, wherein the second scroll piece includes a plurality of mounting lobes that are circumferentially spaced apart from each other and extend radially outward from an outer rim of the second scroll piece, and wherein one or more of the mounting lobes contacts the suction conduit.

* * * * *